US010639236B2

(12) United States Patent
Vassallo et al.

(10) Patent No.: US 10,639,236 B2
(45) **Date of Patent: *May 5, 2020**

(54) PEDIATRIC DOSING DISPENSER

(71) Applicant: Berry Plastics Corporation, Evansville, IN (US)

(72) Inventors: John A. Vassallo, Lititz, PA (US); Steven Gift, Lititz, PA (US); W. Gordon Beecroft, Leola, PA (US)

(73) Assignee: Berry Plastics Corporation, Evansville, IN (US)

( * ) Notice: Subject to any disclaimer, the term of this patent is extended or adjusted under 35 U.S.C. 154(b) by 231 days.

This patent is subject to a terminal disclaimer.

(21) Appl. No.: 15/835,523

(22) Filed: Dec. 8, 2017

(65) Prior Publication Data

US 2018/0098913 A1 Apr. 12, 2018

Related U.S. Application Data

(63) Continuation of application No. 14/881,083, filed on Oct. 12, 2015, now Pat. No. 9,849,067, which is a continuation-in-part of application No. 13/722,674, filed on Dec. 20, 2012, now Pat. No. 9,156,569.

(60) Provisional application No. 61/578,765, filed on Dec. 21, 2011.

(51) Int. Cl.

| | |
|---|---|
| ***A61J 1/14*** | (2006.01) |
| ***B65D 47/08*** | (2006.01) |
| ***B65D 47/20*** | (2006.01) |
| *A61J 1/05* | (2006.01) |

(52) U.S. Cl.

CPC ..... *A61J 1/1418* (2015.05); *B65D 47/0804* (2013.01); *B65D 47/2037* (2013.01); *B65D 47/2056* (2013.01); *A61J 1/05* (2013.01)

(58) Field of Classification Search

CPC ..... A61J 1/1431; A61J 1/1425; A61J 1/1412; A61J 1/1418; A61J 1/05; B65D 47/2056; B65D 47/0804; B65D 47/2037

See application file for complete search history.

(56) References Cited

U.S. PATENT DOCUMENTS

| | | | | |
|---|---|---|---|---|
| 3,853,157 | A | 12/1974 | Madaio | |
| 4,493,348 | A | 1/1985 | Lemmons | |
| 5,573,516 | A | 11/1996 | Tyner | |
| 5,620,434 | A | 4/1997 | Brony | |
| 5,911,252 | A | 6/1999 | Cassel | |
| 7,077,176 | B2 | 7/2006 | Py | |
| 7,568,509 | B2 | 8/2009 | Py | |
| 8,211,082 | B2 | 7/2012 | Hasegawa | |
| 8,272,411 | B2 | 9/2012 | Py | |
| 8,459,312 | B2 | 6/2013 | Manera | |
| 9,156,569 | B2 | 10/2015 | Vassallo | |
| 9,296,531 | B2 | 3/2016 | Luzbetak | |
| 9,849,067 | B2 * | 12/2017 | Vassallo | B65D 47/0804 |

(Continued)

FOREIGN PATENT DOCUMENTS

| | | |
|---|---|---|
| WO | 2013003293 | 1/2013 |

*Primary Examiner* — Nicolas A Arnett

(74) *Attorney, Agent, or Firm* — Barnes & Thornburg LLP

(57) ABSTRACT

A package that is configured to store and dispense fluids. The package includes a container and a dosing dispenser for closing an opening to the container. The dosing dispenser includes a body portion having a syringe receiver and a valve assembly that is configured to permit the flow of fluid from the container to the syringe.

20 Claims, 20 Drawing Sheets

(56) References Cited

U.S. PATENT DOCUMENTS

| | | | |
|---|---|---|---|
| 2005/0178462 | A1 | 8/2005 | Py |
| 2007/0084524 | A1 | 4/2007 | Py |
| 2007/0214692 | A1 | 9/2007 | Ferrara |
| 2010/0063473 | A1 | 3/2010 | Schwarz |
| 2010/0154245 | A1 | 6/2010 | Py |
| 2011/0168292 | A1 | 7/2011 | Luzbetak |
| 2012/0103468 | A1 | 5/2012 | Terwilliger |
| 2012/0103469 | A1 | 5/2012 | Terwilliger |
| 2012/0103470 | A1 | 5/2012 | Terwilliger |
| 2012/0104054 | A1 | 5/2012 | Terwilliger |
| 2013/0160891 | A1 | 6/2013 | Vassallo |
| 2013/0180618 | A1 | 7/2013 | Py |
| 2014/0261860 | A1 | 9/2014 | Heath |

* cited by examiner

PEDIATRIC DOSING DISPENSER

PRIORITY CLAIM

This application is a continuation application of U.S. application Ser. No. 14/881,083, filed Oct. 12, 2015, which is a continuation-in-part application of U.S. application Ser. No. 13/722,674, filed Dec. 20, 2012, which claims priority under 35 U.S.C. § 119(e) to U.S. Provisional Application No. 61/578,765, filed Dec. 21, 2011, each of which is expressly incorporated by reference herein.

BACKGROUND

The present disclosure relates to dosing dispensers for mounting on the top of bottles, or other containers, and in particular, to a dosing dispenser including a body portion coupled to a container and a flip-top cap coupled to the body portion. More particularly, the present disclosure relates to a dosing dispenser with a syringe receiver configured to accept a syringe to allow a user to dose liquid into the syringe.

SUMMARY

A package, in accordance with the present disclosure, is configured to store and dispense fluids. The package includes a container and a dosing dispenser for closing an opening to the container.

In illustrative embodiments, the dosing dispenser includes a body portion and a flip-top cap pivotably coupled to the body portion and movable to a closed position on the body portion to conceal a syringe receiver. The dosing dispenser is provided with a valve assembly that is configured to permit the flow of fluid through a syringe receiver when a portion of the syringe is inserted into the syringe receiver and to prevent the flow of fluid when the syringe is removed. The valve assembly limits the unwanted discharge of fluid from the dosing dispenser when a syringe is not present.

In illustrative embodiments, the valve assembly includes a valve provided with a tapered elastic wall formed to include a slit at the lower end. The elastic wall is adapted to maintain the slit in a closed position to prevent unwanted fluid flow from the container. Inserting the fluid-transfer tip of the syringe into the syringe receiver causes outward movement of the elastic wall to cause the slit to open to permit fluid flow.

In illustrative embodiments, the valve assembly may include a valve may include an annular upper flange and an annular lower flange with an annular channel formed between the upper and lower flanges to permit the valve assembly to be coupled to an aperture formed in the body portion. The annular lower flange includes a tapered face to permit the valve assembly to be inserted in the aperture to secure the valve assembly to the body portion.

Additional features of the disclosure will become apparent to those skilled in the art upon consideration of the following detail description of illustrative embodiments exemplify the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
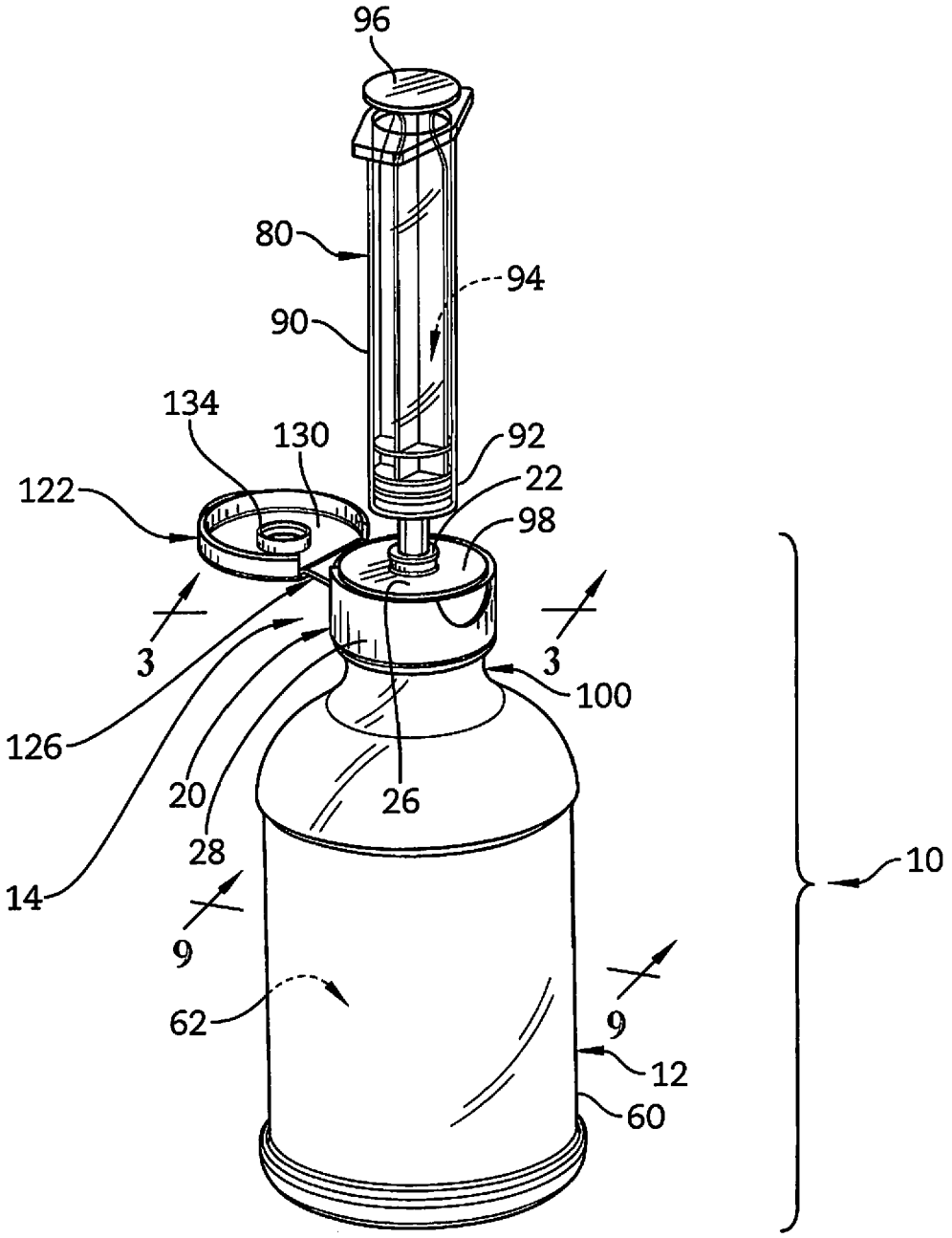
FIG. 1 is a perspective view of a package and a syringe in accordance with the present disclosure, showing a container and a dosing dispenser coupled to the container, the dosing dispenser including a body portion coupled to the container and a flip-top cap shown pivoted to an opened position to expose a syringe receiver adapted to receive a fluid-transfer tip of the syringe to permit the dosing of fluid from the container to the syringe as suggested in FIGS. 9-11.
Figure 3:
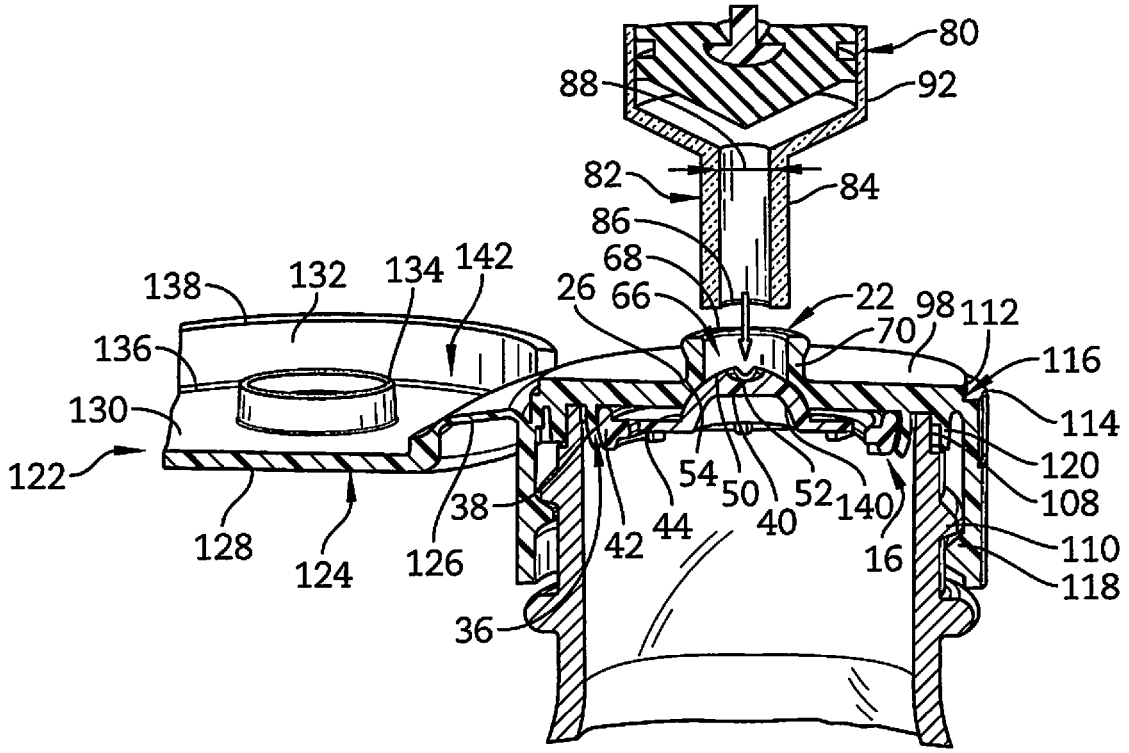
FIG. 3 is a sectional view of the package and syringe taken along line 3-3 of FIG. 1 showing the dosing dispenser before the fluid-transfer tip of the syringe is inserted into the syringe receiver and showing the valve assembly coupled to the body portion of the dosing dispenser, the valve assembling including a dome-shaped valve positioned within the opening of the syringe receiver to block the flow of fluid from the container.
Figure 4:
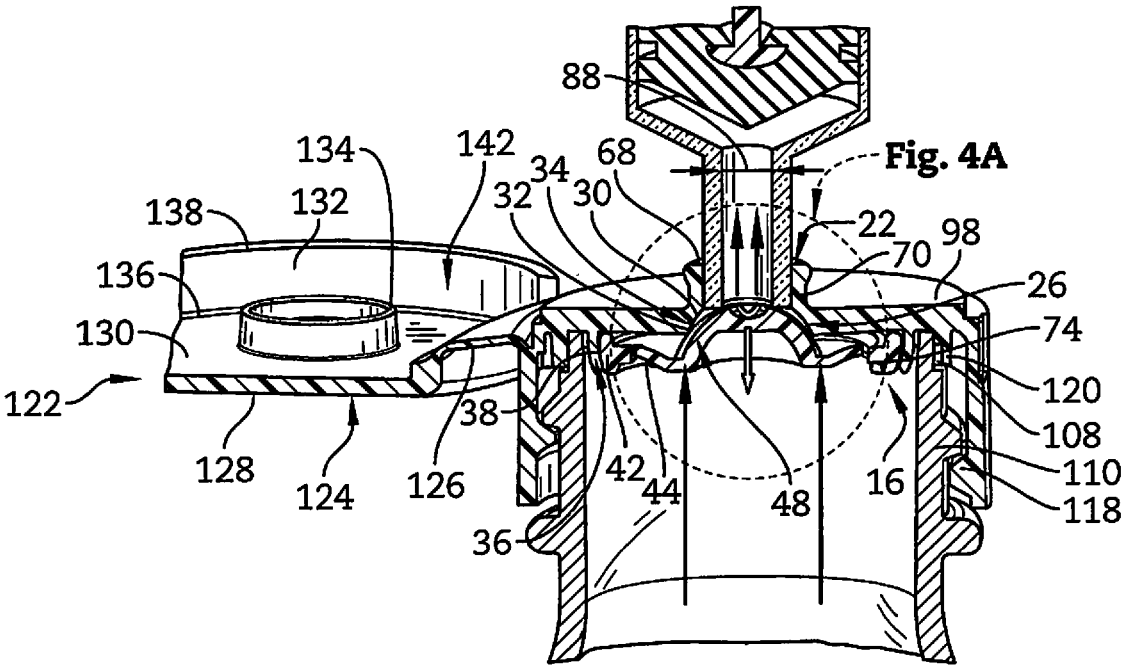
FIG. 4 is a partial sectional view of the package and syringe taken along line 3-3 of FIG. 1 showing the dosing dispenser after the fluid-transfer tip of the syringe has been inserted into the syringe receiver, and showing the fluid-transfer tip engaging the dome-shaped valve of the valve assembly to move the valve in a downward direction to unseat the valve to permit the flow of fluid into the fluid-transfer tip of the syringe, as indicated by the double arrows.

A package 10 in accordance with the present disclosure includes a container 12 and a dosing dispenser 14 coupled to a filler neck 100 of container 12, as shown, for example, in FIG. 1. Dosing dispenser 14 includes body portion 20 adapted to be mounted on container 12 and includes a flip-top cap 122 that is pivotably coupled to body portion 20 to conceal a syringe receiver 22. Syringe receiver 22 is configured to accept a fluid-transfer tip 82 of a syringe 80 to permit the dosing of liquid from container 12, as shown in FIGS. 3-4.

Figure 2:
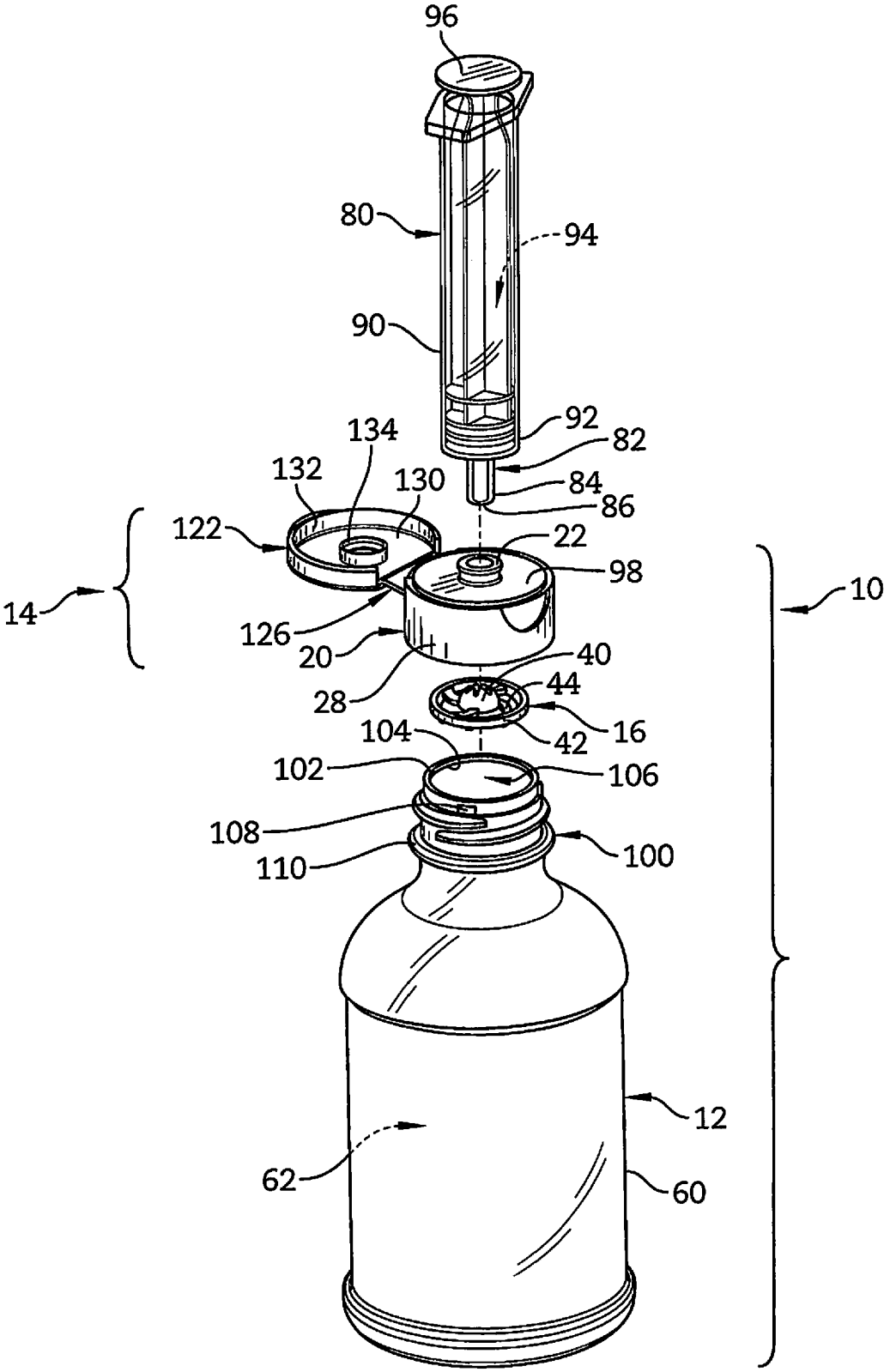
FIG. 2 is an exploded assembly view of the package of FIG. 1 along with the syringe for dosing fluid from the container and showing the dosing dispenser and a valve assembly that is configured to be coupled to the dosing dispenser to block the flow of fluid through the syringe receiver until the fluid-transfer tip of the syringe is inserted into the syringe receiver, as suggested in FIGS. 3-4*a;*
Figure 7:
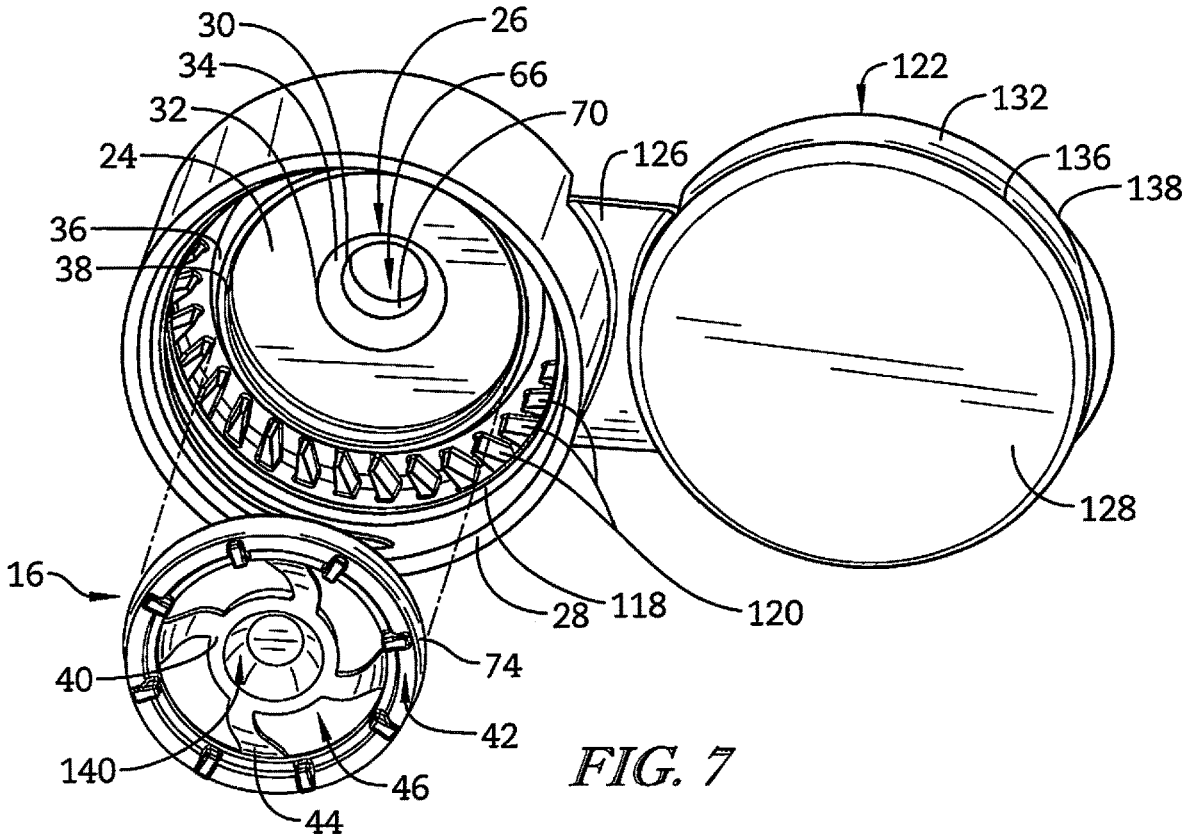
FIG. 7 is a perspective view of the underside of the dosing dispenser showing the valve assembly aligned to be inserted into the base portion of the dosing dispenser, the base portion including an inside surface that is provided with a downwardly depending annular mounting lock and a conical valve seat positioned radially inwardly from the mounting lock, the valve seat being configured to receive the valve of the valve assembly, and the mounting lock being adapted to lock the attachment ring to the body portion of the dosing dispenser when the valve assembly is installed into the dosing dispenser.
Figure 8:
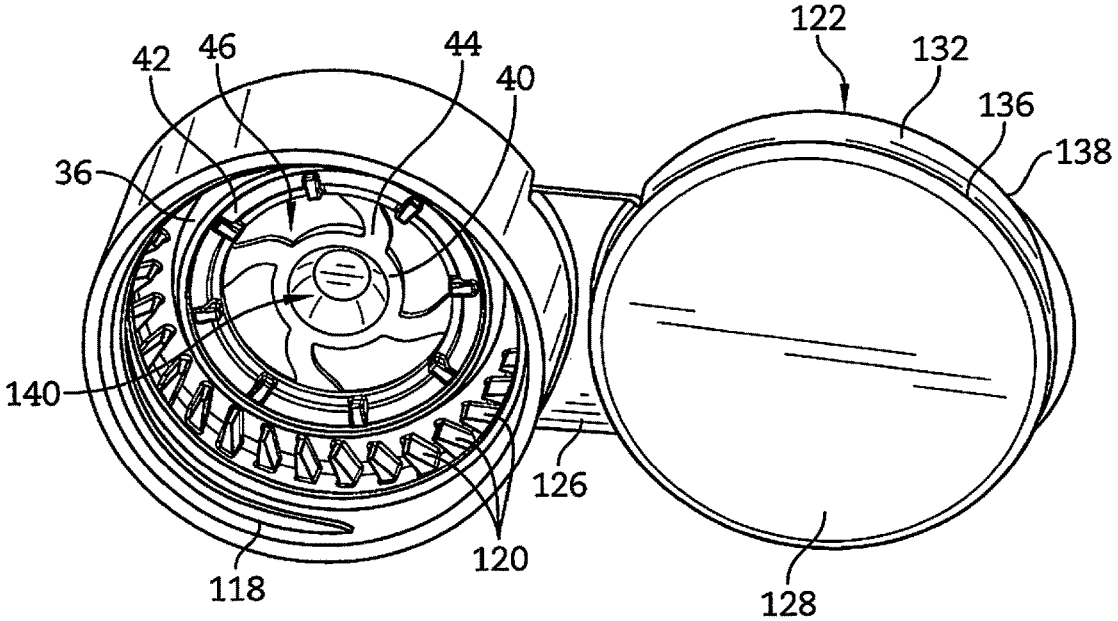
FIG. 8 is a perspective view similar to FIG. 7 showing the valve assembly attached to the inside surface of the dosing dispenser and showing an annular side wall having attachment threads and a series of locking blocks that extend radially inwardly to engage with corresponding locking lugs formed on the neck finish of the container, as suggested in FIG. 15 to lock the dosing dispenser to the container.

Body portion 20 of dosing dispenser 14 includes a top wall 98 and an annular side wall 28 depending from top wall 98, as shown in FIG. 2. Dosing dispenser 14 also includes a valve assembly 16 that is configured to be coupled to an inside surface 24 of top wall 98, as shown in FIGS. 7-8. Valve assembly 16 blocks the flow of liquid from container 12 through syringe receiver 22 unless fluid-transfer tip 82 of syringe 80 is inserted into syringe receiver 22, as shown in FIGS. 3-4.

Figure 4A:
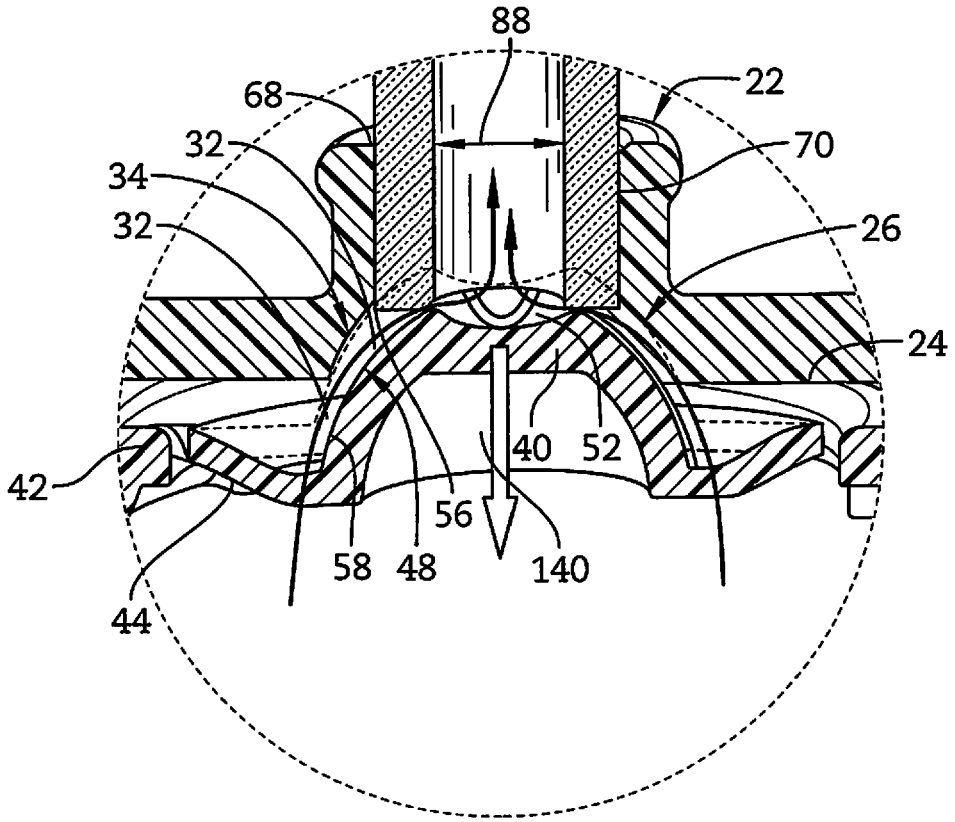
FIG. 4*a* is an enlarged view of FIG. 4 showing the movement of the valve of the valve assembly from a closed position, shown in phantom, where it is in sealing engagement with a valve seat of the syringe receiver to an opened, unseated position to permit the flow of fluid through flow channels of the valve into the fluid-transfer tip of the syringe as indicated by the arrows.
Figure 5:
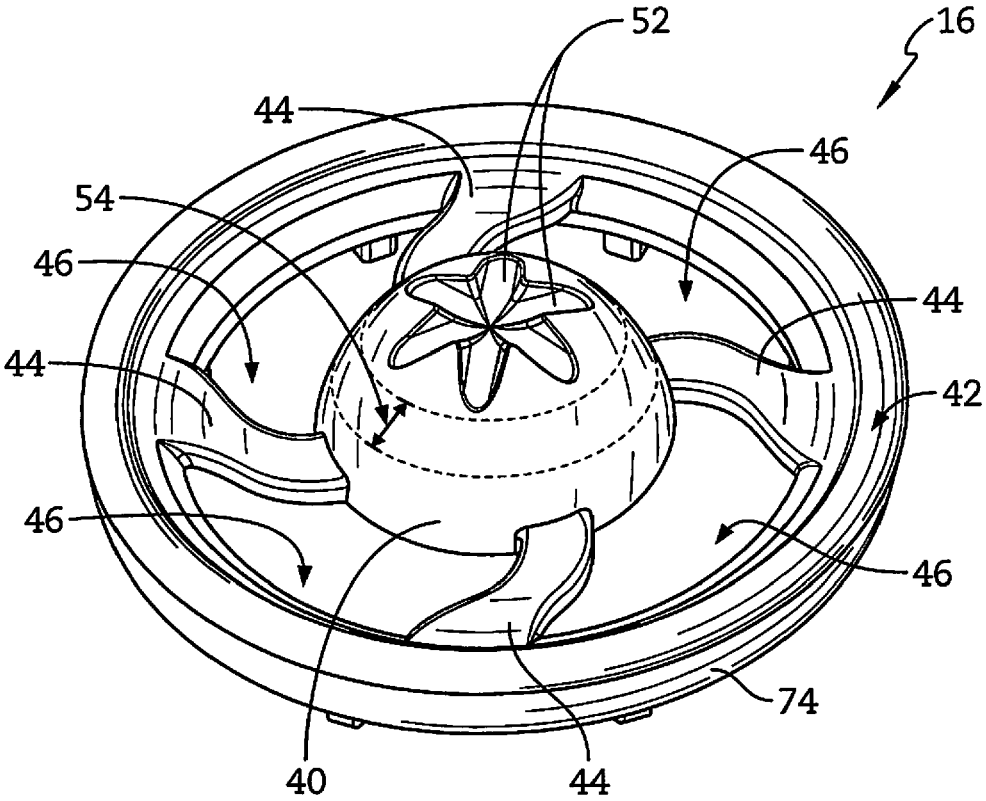
FIG. 5 is a perspective view of the top side of the valve assembly of FIGS. 2-4*a* showing the dome-shaped valve, an attachment ring and a series of flexible connectors coupling the valve to the attachment ring, the valve including a series of flow channels to permit the flow of fluid past the valve and into the fluid-transfer tip of the syringe, the flow channels being positioned above a sealing surface of the valve, and the attachment ring being configured to be coupled with the mounting lock of the body portion of the dosing dispenser, as suggested in FIGS. 7-8.
Figure 6:
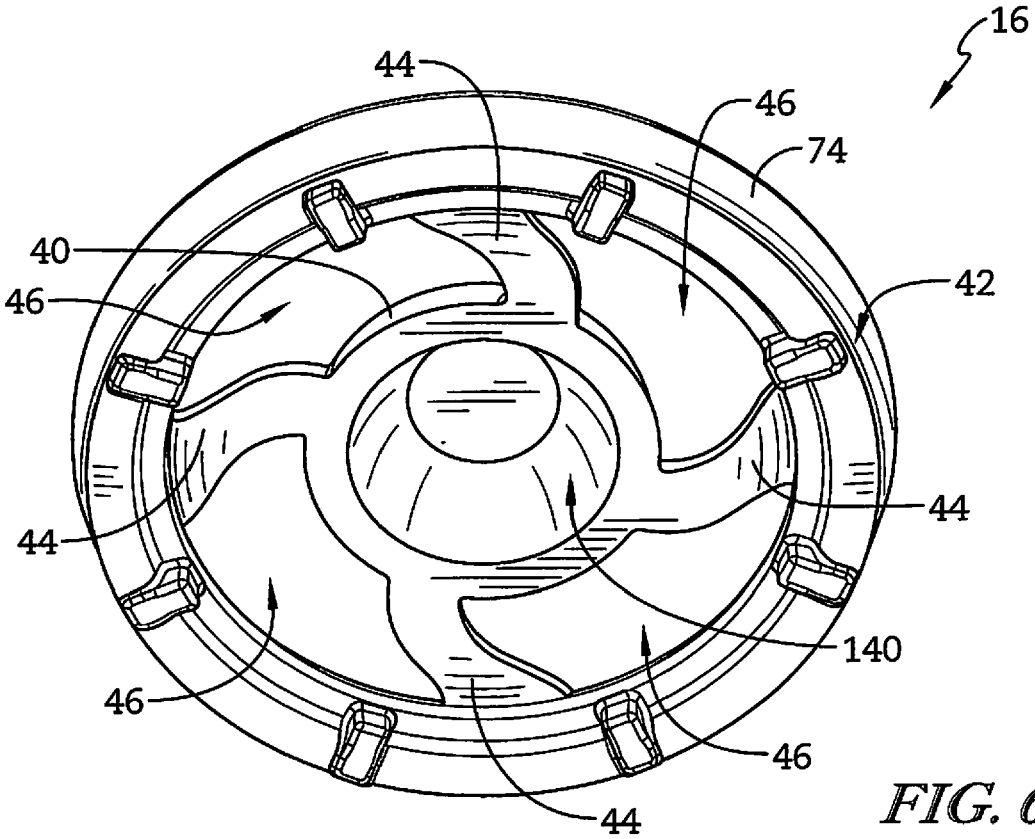
FIG. 6 is bottom perspective view of the valve assembly of FIG. 5 showing a concavity formed in the underside valve assembly.

Valve assembly 16 includes a valve 40, an attachment ring 42, and a series of flexible connectors 44 that couple valve 40 to attachment ring 42, as shown, for example, in FIGS. 5 and 6. Flexible connectors 44 are configured and arranged to bias valve 40 towards valve seat 26 to form a seal to block the transfer of fluid from container 12 through syringe receiver 22, as shown in FIG. 4A. While valve assembly 16 is illustratively made from a thermoplastic elastomeric material (TPE), it is contemplated that other elastomers or plastics materials can be used in accordance with the present disclosure.

Valve 40 of valve assembly 16 is a dome-shaped structure that includes a series of flow channels 52 and a sealing zone 54, as shown, for example, in FIG. 5. Valve 40 is configured to seal with a valve seat 26 formed on an inside surface 24 of body portion 20, as shown, for example, in FIG. 7. Valve 40 is also formed to include a concavity 140 on the underside of valve 40 to permit deformation of valve 40 when in contact with valve seat 26 of body portion 20, as shown in FIG. 6. While a dome-shaped structure is used, it is within the scope of the present disclosure to make valve 40 in various shapes to accomplish the desired sealing result, such as a conical or pyramidal shape, for example.

Flow channels 52 of valve 40 provide conduits to permit fluid to flow from container 12 into an inlet orifice 86 of fluid transfer tip 82 of syringe 80, when valve 40 is in an opened position and plunger 96 is drawn rearward, as shown in FIGS. 4-4*a*. Sealing region 54 of valve 40 is an area that is in contact with valve seat 26 when valve 40 is biased to a closed position to create a liquid-tight seal. Flow channels 52 are positioned outside of sealing region 54 so that no fluid can pass through sealing region 54 when valve 40 is in a closed position. When valve assembly 16 is coupled with dosing dispenser 14, valve 40 sealably engages with valve seat 26 via sealing region 54.

Attachment ring 42 of valve assembly 16 is configured to be coupled to top wall 98 of body portion 20, as shown, for example, in FIGS. 7 and 8. Inside surface 24 of body portion 20 includes an outwardly extending mounting lock 36 that is used to secure attachment ring 42 to base portion 20. Mounting lock 36 is annular and reduces in diameter as it extends away from inside surface 24 of body portion 20. Mounting lock 36 is configured to receive an outer surface 74 of attachment ring 42 to hold attachment ring 42 in position against top wall 98 of body portion 20. When attachment ring 42 is secured to mounting lock 36, flexible connectors 44 bias valve 40 against valve seat 26.

Flexible connectors 44 are adapted to connect attachment ring 42 to valve 40 and also bias valve 40 against valve seat 26 when no outside forces are applied to valve 40, as shown in FIGS. 5 and 6. Flexible connectors 44 are generally equally spaced around valve 40 to provide uniform biasing forces to valve 40 so that movement of valve 40 with respect to valve seat 26 is generally linear when force by a syringe is applied. When force is applied to valve 40 by syringe 80, flexible connectors 44 yield to allow valve 40 to separate from seat 26 to permit the flow of fluid material 64 between valve 40 and valve seat 26. Flexible connectors 44 of valve assembly 16 form a series of flow apertures 46 to allow for the flow of fluid material 64 through flow apertures 46, as shown in FIG. 5.

Figure 9:
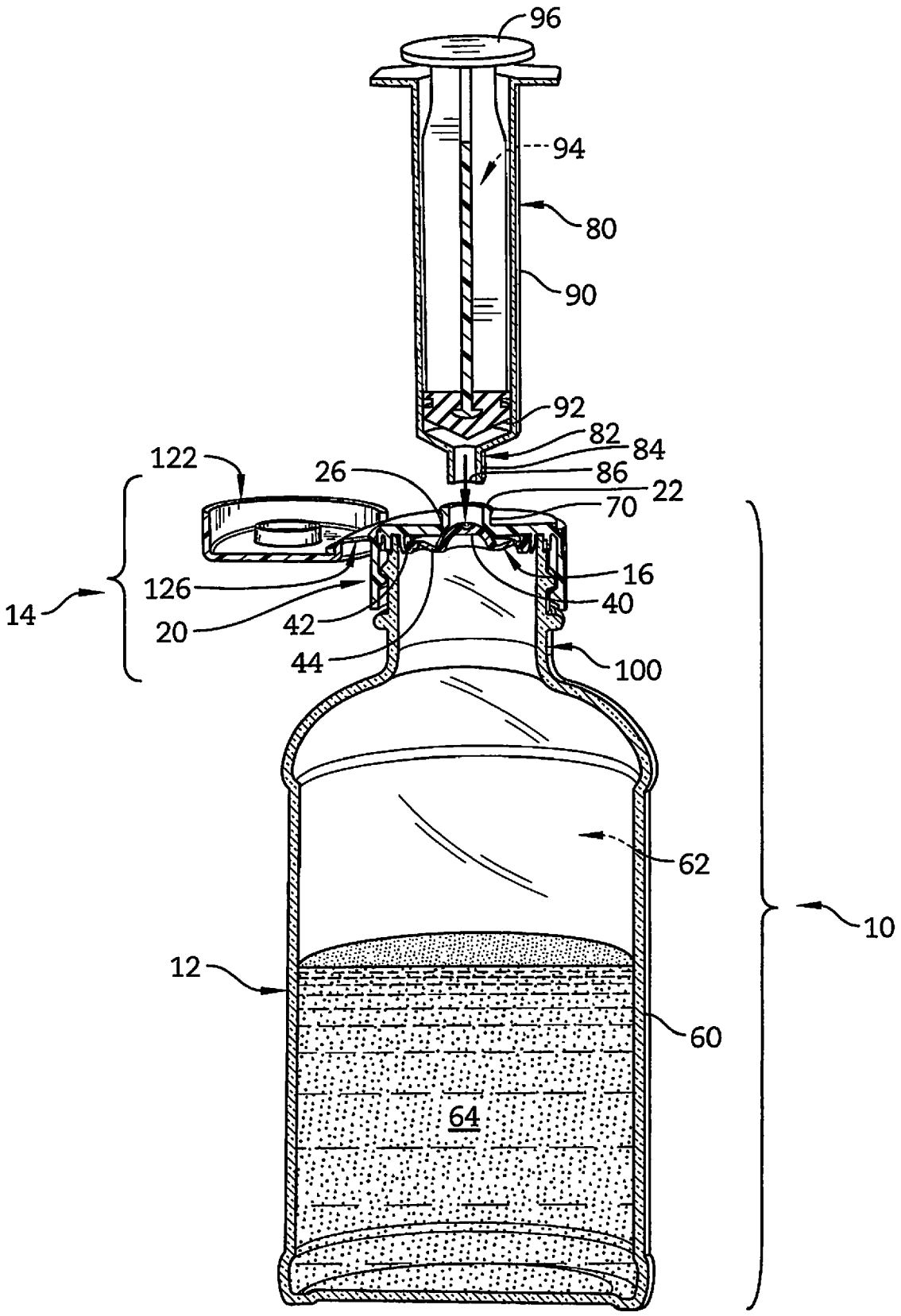
FIG. 9 is a sectional view of the package and syringe taken along line 9-9 of FIG. 1, showing the syringe moving in the direction of the arrow to allow insertion of the fluid-transfer tip into the syringe receiver of the dosing dispenser, the syringe including a plunger movable in a stationary tube relative to an inlet-outlet orifice formed in the fluid-transfer tip of the syringe, and the fluid-transfer tip being provided at a lower end of the stationary tube.
Figure 10:
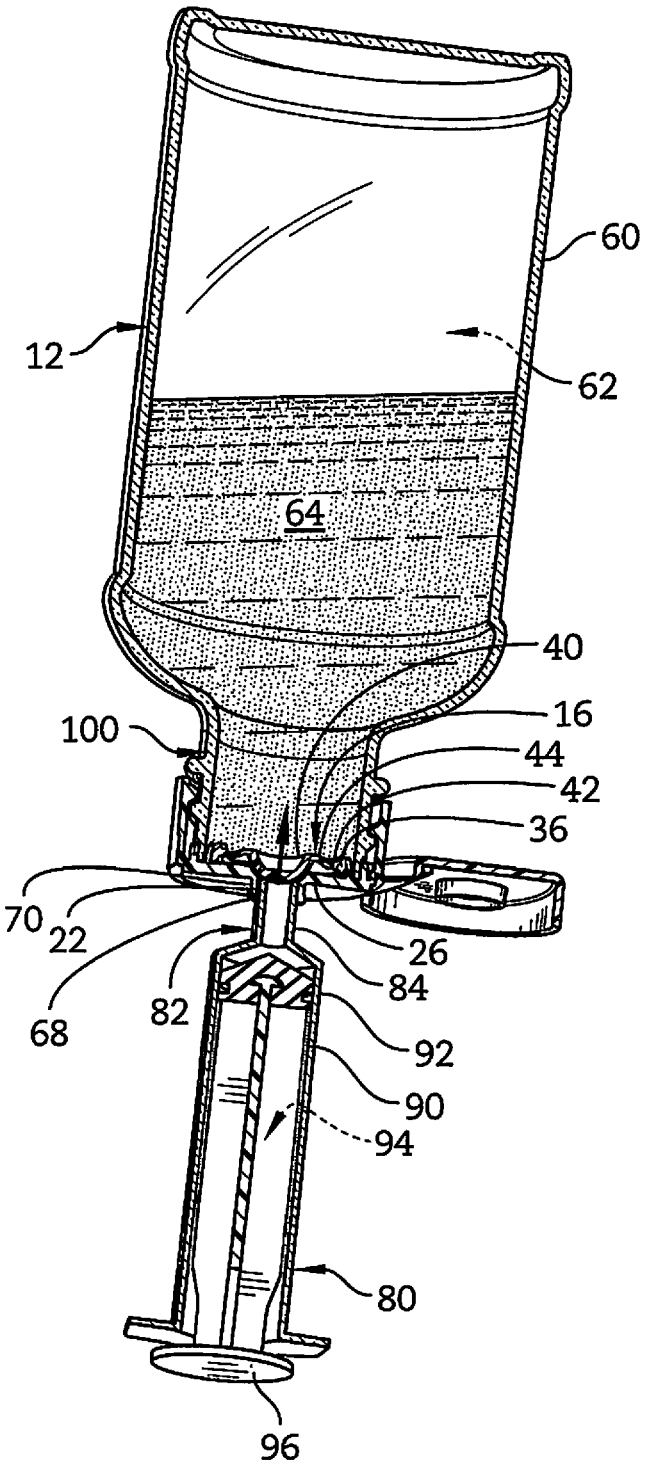
FIG. 10 is a sectional view similar to FIG. 9 showing the container and dosing dispenser in an inverted position and the fluid-transfer tip of the syringe being inserted into the syringe receiver of the dosing dispenser to move the valve of the valve assembly to an opened position to permit the dosing of fluid from the container.
Figure 11:
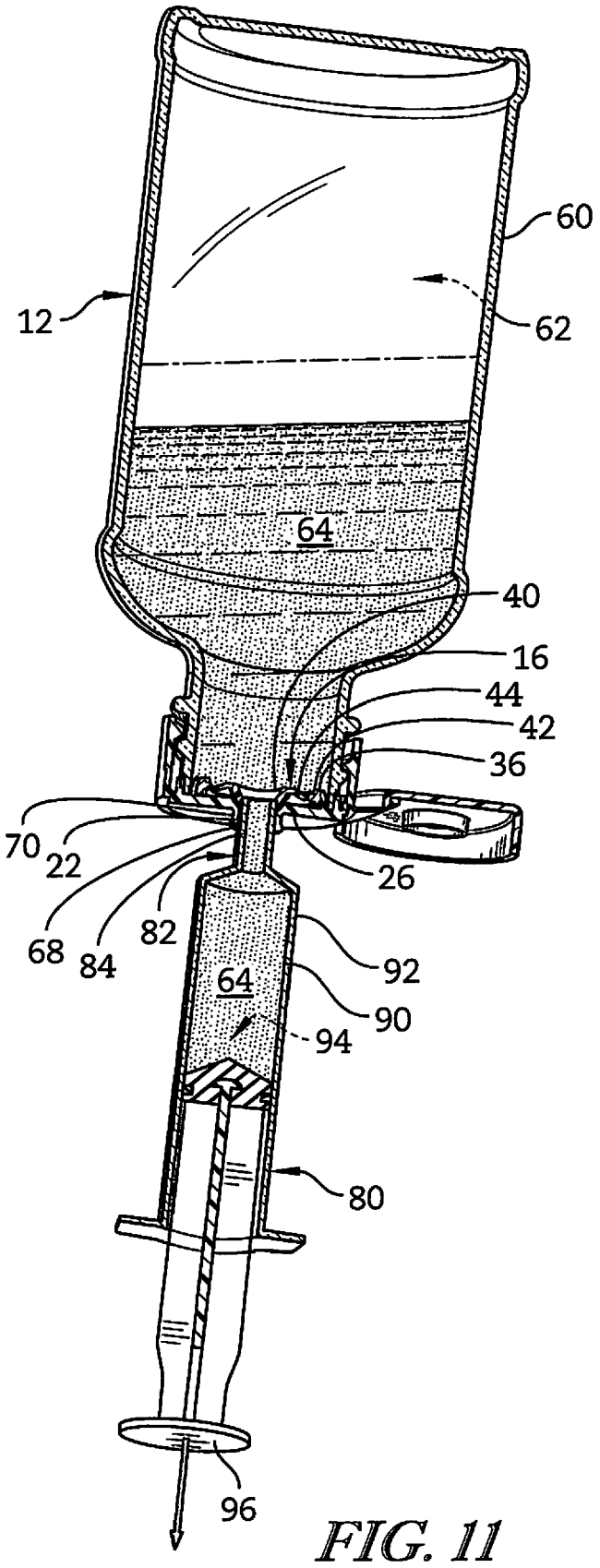
FIG. 11 is a sectional view similar to FIGS. 9-10 showing downward movement of the plunger in the syringe relative to the stationary tube to draw fluid material from the container, past the valve, and into a fluid-storage chamber of the stationary tube included in the syringe through fluid-transfer tip as it engages with the syringe receiver and valve of the dosing dispenser.

Syringe receiver 22 of dosing dispenser 14 is adapted to mate with syringe 80 or similar fluid exporting instrument to allow for the dosing of fluid material 64 from interior region 62 of a fluid-storage body 60, as shown, for example, in FIGS. 9-11. In particular, syringe receiver 22 is formed to include an exterior opening 68 for receiving fluid-transfer tip 82 of syringe 80, as shown in FIGS. 3-4. Syringe receiver 22 forms a discharge port means 66 for allowing fluid material 64 to flow from interior region 62 of fluid-storage body 60, through syringe receiver 22, and into syringe 80.

Inside surface 24 of body portion 20 includes valve seat 26, as shown, for example, in FIGS. 4 and 7. Valve seat 26 lies in vertical alignment with syringe receiver 22, which includes an interior opening 68 that lies near valve seat 26. Valve seat 26 is conically shaped and tapers from an inner diameter 30 that abuts syringe receiver 22 to an outer diameter 32 that abuts inside surface 24. Valve seat 26 also includes a second sealing face 34 that extends from inner diameter 30 to outer diameter 32, second sealing face 34 is configured to engage with first sealing face 48 of valve 40 when valve 40 is in a closed position.

Top wall 98 of body portion 20 includes an annular vertical wall 112. Annular vertical wall 112 is positioned to lie near and substantially perpendicular to an inner top edge 114 of annular side wall 28 of body portion 20. Annular vertical wall 112 and inner top edge 114 cooperate to form an annular groove 116. When dosing dispenser 14 is coupled to container 12, annual flange 38 is forced into filler neck passageway 106 and abuts against an inside lip 104 of mouth 102 to provide frictional engagement with filler neck 100.

Dosing dispenser 14 also include includes a hinge 140 coupled to body portion 20 and a flip-top cap 122 depending from hinge 140. Dosing dispenser 14 is adapted to seal open mouth 102 in container 12 to allow for selected removal of fluid material 64 from container 12. Hinge 140 is coupled to body portion 20 to support flip-top cap 122 for movement relative to body portion 20 from a closed position on body portion 20 uncovering syringe receiver 22 covering Flip-top cap 122 of dosing dispenser 14 includes a movable lid 124 formed to include an inner chamber 142, as shown, for example, in FIGS. 3 and 4. Movable lid 124 includes a cap top wall 128 and an annular cap side wall 132 depending from cap top wall 128. Annular cap side wall 132 is adapted to be received on body portion 20 when flip-top cap 122 is in a closed position on body portion 20. Annular groove 116 of body portion 20 is adapted to accept annular cap side wall 132 of movable lid 124 when flip-top cap 122 is in the closed position on body portion 20.

Container 12 includes a fluid-storage body 60 formed to include an interior region 62 and filler neck 100 having a mouth 102 opening into a filler-neck passageway 106 communicating with interior region 62 as shown, for example, in FIGS. 1 and 2.

Top wall 98 of movable lid 124 includes a cap inside surface 130 having a plug 134 as shown, for example, in FIG. 1. Plug 134 is adapted to seal syringe receiver 22 when flip-top cap 122 is in the closed position on body portion 20. Annular cap side wall 132 of movable lid 124 includes a first edge 136 depending from top cap wall 128 and a second edge second edge 138 that is spaced apart from first edge 136. Second edge 138 of annular cap side wall 132 is adapted to be coupled with annular groove 116 of body portion 20 when flip-top cap 122 is in the closed position on body portion 20.

Syringe 80 includes a tube 90 formed to include a fluid-storage chamber 94 and fluid-transfer tip 82 coupled to a lower end of stationary tube 90 to cause a tip passageway 84 formed in fluid-transfer tip 82 to lie in fluid communication with fluid-storage chamber 94. Fluid-transfer tip 82 also is formed to include an inlet-outlet orifice 86 opening into tip passageway 84 as suggested in FIGS. 3 and 4. Syringe 80 also includes a plunger 96 mounted for movement in fluid-storage chamber 94 relative to stationary tube 90 to generate a suction force sufficient to draw fluid material 64 from interior region 62 in fluid-storage body into fluid-storage chamber 94 via tubular sleeve 70 in syringe receiver 22 and tip passageway 84 in fluid-transfer tip 82 in syringe 80, as suggested in FIGS. 9-11.

Dosing dispenser 14 is configured to mate with filler neck 100 using any suitable means to close open mouth 102 and is further configured to be lockably retained on filler neck 100 once it is mated on filler neck 100. Filler neck 100 includes one or more engagement lugs 108 that project in a radially outwardly extending direction away from interior region 62 of fluid-storage body 60. Dosing dispenser 14 includes inside surface 24 with one or more locking retention lugs 120 that project in a radially inwardly extending direction toward interior region 62 of fluid-storage body 60. When dosing dispenser 14 is mated onto filler neck 100, locking retention lugs 120 and engagement lugs 108 engage each other, causing dosing dispenser 14 to be irremovable from fluid-storage body 60.

A valve assembly 210 in accordance with another embodiment of the present disclosure is shown, for example, in FIGS. 12-14*a*. Valve assembly 210 functions similar to valve assembly 16 of FIGS. 1-11 but includes a different configuration for biasing valve 212 towards valve seat 26. Valve assembly 210 includes a cantilever arm 218 that connects valve 212 to attachment ring 216.

Figure 12:
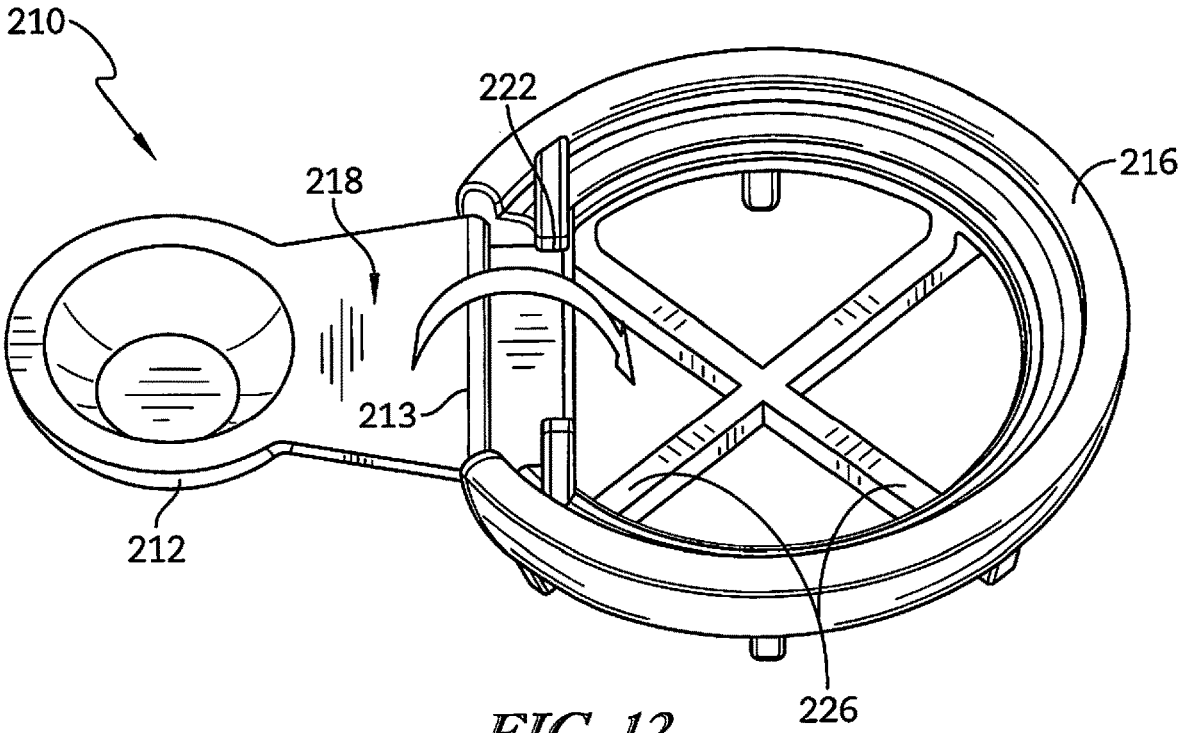
FIG. 12 is a perspective view of another embodiment of the valve assembly of the present disclosure, showing the valve assembly in a molded position and having a valve, an attachment ring, and a cantilever arm connecting the valve to the attachment ring, the cantilever arm being configured to be rotated about an axis to position the valve within the attachment ring, as suggested in FIG. 13.
Figure 13:
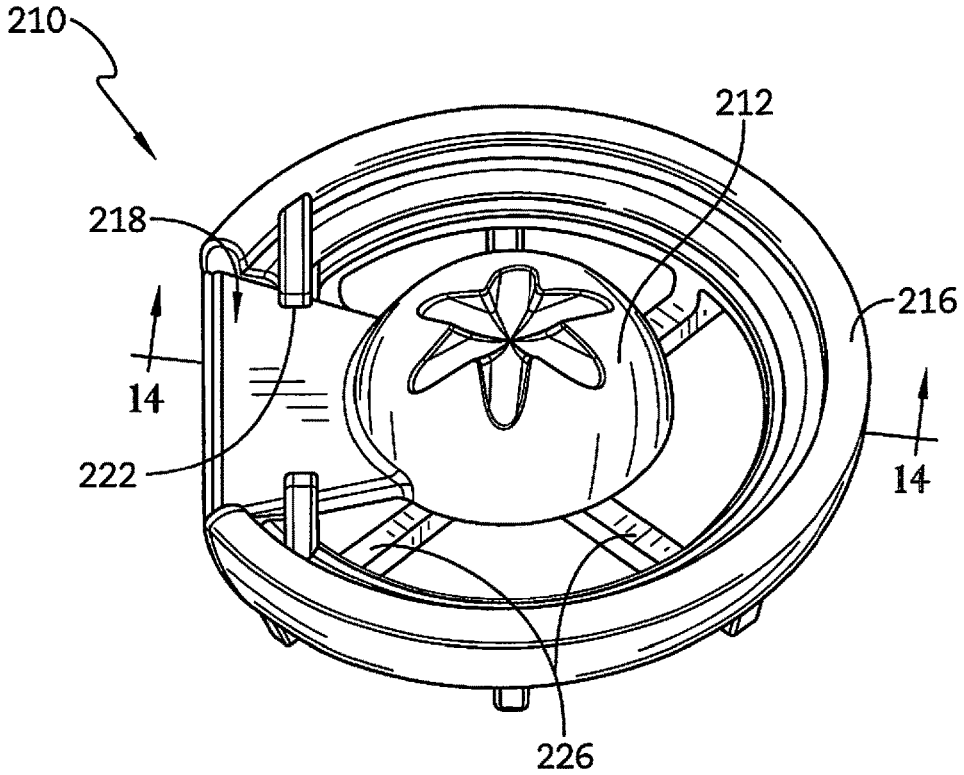
FIG. 13 is another perspective view of FIG. 12 showing the valve assembly in the in-use position with the valve positioned within the attachment ring and the cantilever arm being locked in a position by use of a pair of retainers that engage and secure the cantilever arm, and the cantilever arm being configured to deflect downwardly in response to downward force applied to the valve by the fluid-transfer tip of the syringe.

Cantilever arm 218 of valve assembly 210 attaches to valve 212 and provides a biasing force to bias valve 212 against valve seat 26. During the manufacture of valve assembly 210, cantilever arm 218 and valve 212 are molded to the outside of attachment ring 216, as shown in FIG. 12. During finishing, cantilever arm 218 and valve 212 are pivoted about axis 213, over into the center of attachment ring 216 and snapped into retainers 222, as shown in FIG. 13.

Figure 14:
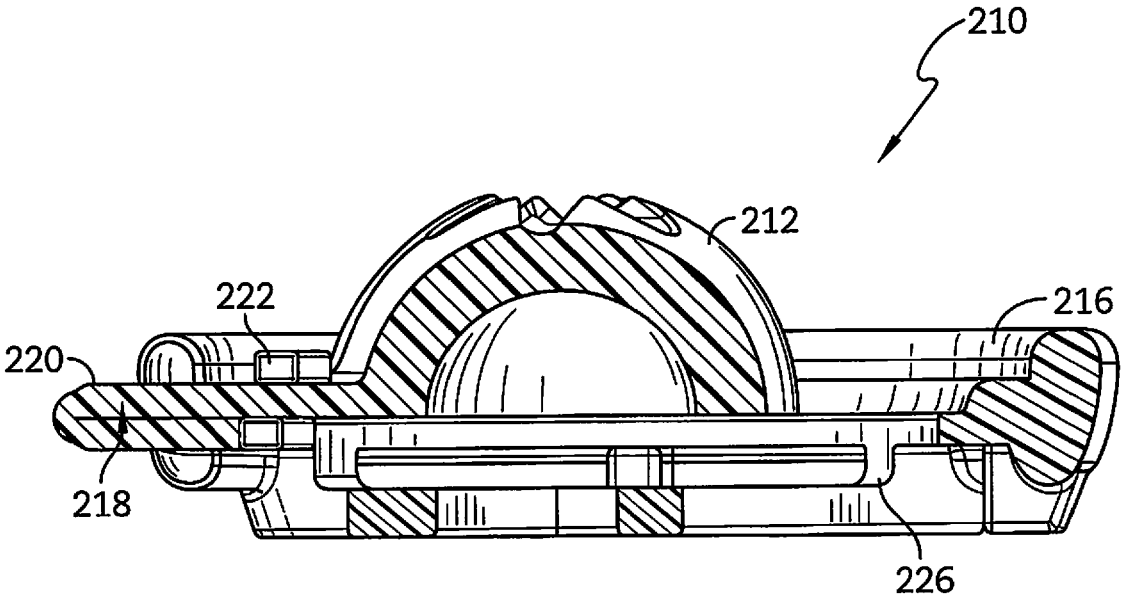
FIG. 14 is a sectional view taken along line 14-14 of FIG. 13 showing the position of the valve with respect to the attachment ring prior to a force being applied to the valve by the fluid-transfer tip of the syringe.
Figure 14A:
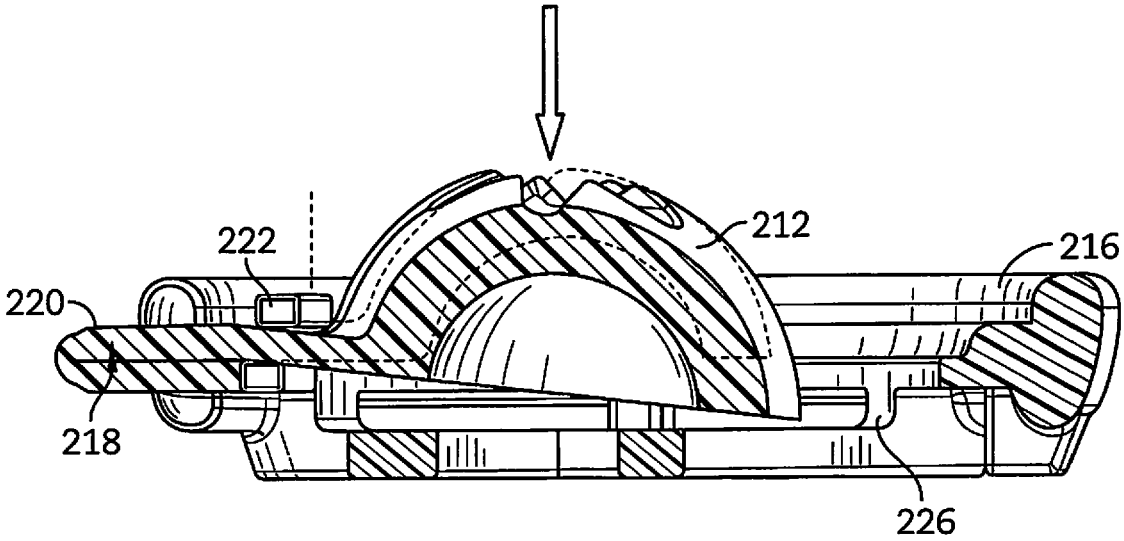
FIG. 14*a* is a sectional view similar to FIG. 14 showing the downward deflection of the valve and cantilever arm with respect to the attachment ring when a force is applied to the valve by the fluid-transfer tip of the syringe.
Figure 15:
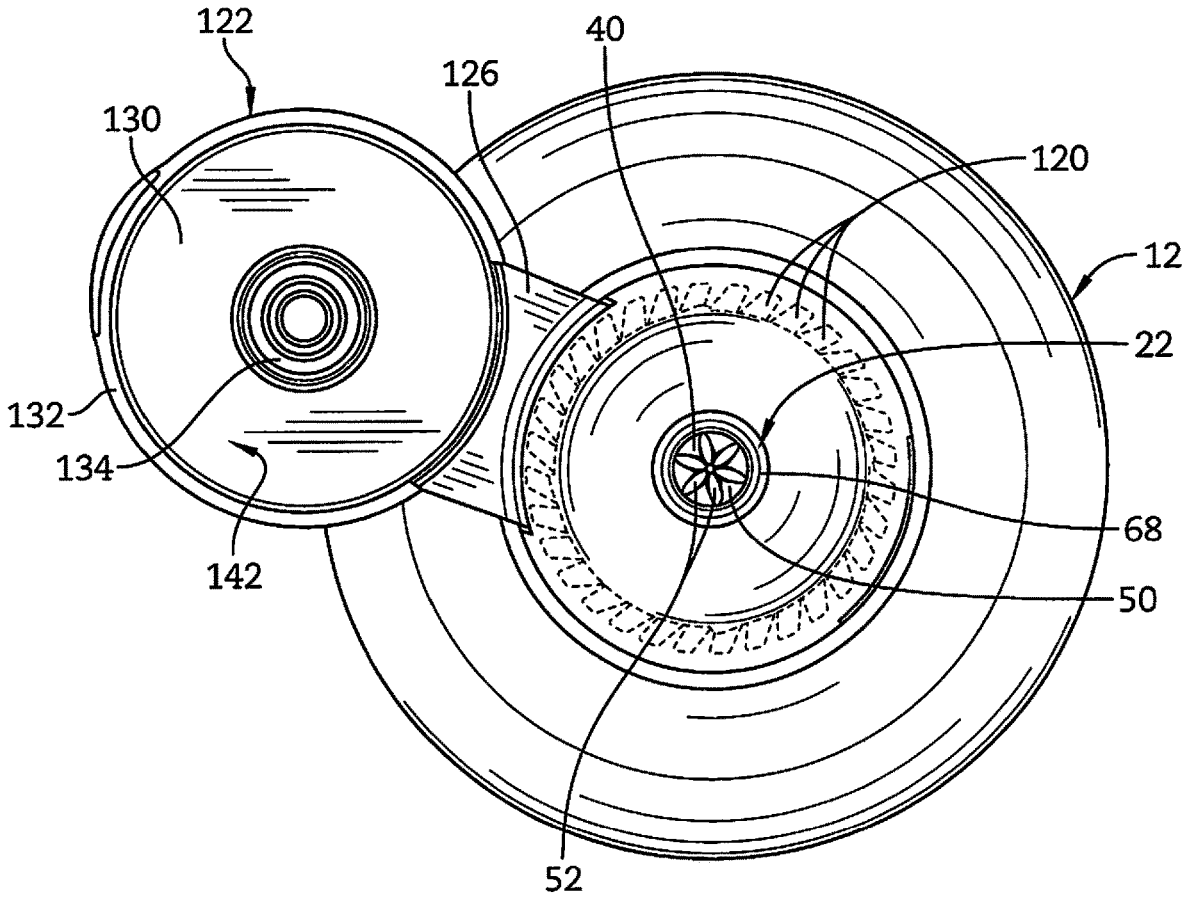
FIG. 15 is a top view of the container and dosing dispenser showing the flow channels of the valve in line with the syringe receiver and also showing the series of radially extending locking blocks engaging locking lugs formed on the neck finish of the container.
Figure 16:
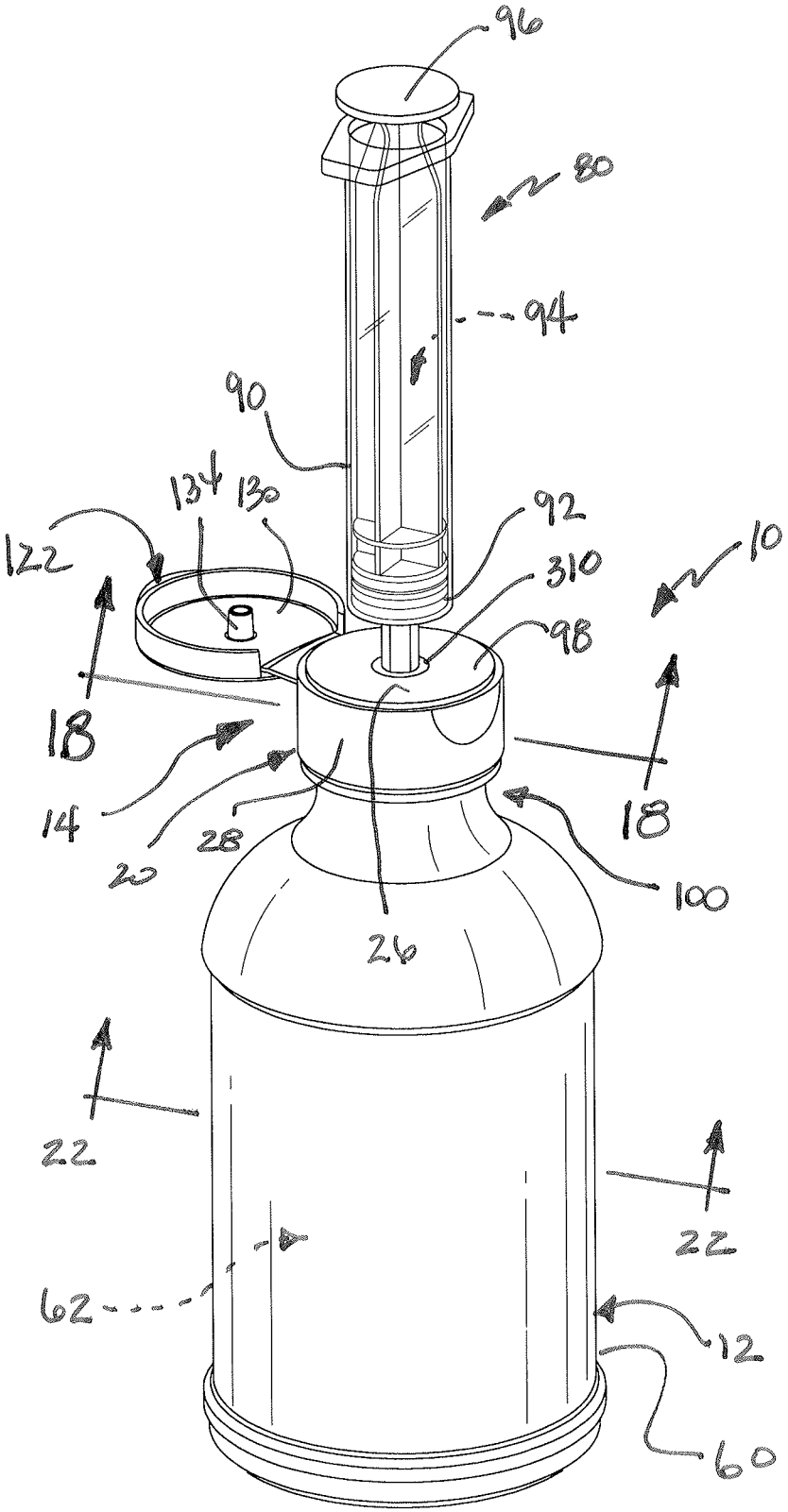
FIG. 16 is a is a perspective view of another embodiment of a package and a syringe in accordance with the present disclosure, showing a container and a dosing dispenser coupled to the container, the dosing dispenser including a body portion coupled to the container and a flip-top cap shown pivoted to an opened position to expose a syringe receiver adapted to receive a fluid-transfer tip of the syringe to permit the dosing of fluid from the container to the syringe as suggested in FIGS. 22-24.

Cantilever arm 218 of valve assembly 210 snaps into retainers 222 to secure cantilever arm 218 and valve 212 in an in-use position. Once in position, the portion of cantilever arm 218 that extends between retainers 222 and valve 212 flexes to bias valve 212 against valve seat 26 when in use, as shown in FIGS. 14 and 14*a*. Valve assembly 210 includes one or more rigidity members 226 that span across attachment ring 216, below valve 212. Rigidity members 226 provide structural support to valve assembly 210.

Valve assembly 16 includes a valve 40 that provides a seal with an valve seat 26 included in an inside surface 24 of body portion 20 of dosing dispenser 14 as seen in FIGS. 3 and 4. This seal is broken when a force is applied to valve 40 in the direction of an interior region 62 of a fluid-storage body 60 of container 12, allowing for fluid material 64 to flow from interior region 62 through syringe receiver 22 into a syringe 80.

In particular, syringe receiver 22 is adapted to mate with syringe 80 to allow a user to transfer fluid material 64 from container 12 into syringe 80 through valve assembly 16 and syringe receiver 22, as suggested in FIGS. 9-11. A fluid-transfer tip 82 of syringe 80 applies force on valve 40 in the direction of interior region 62, breaking the seal to allow fluid to flow into syringe 80.

Figure 20:
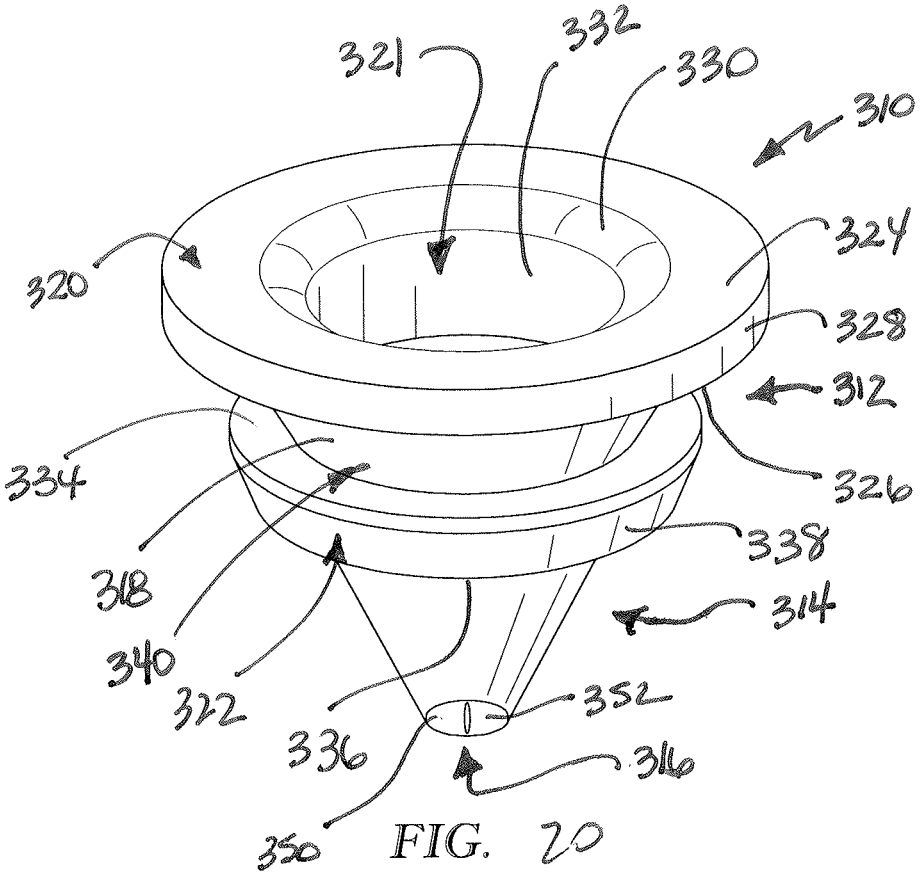
FIG. 20 is a perspective view of the top side of the valve assembly of FIGS. 16-19*a* showing upper and lower annular flanges with an annular channel formed between the flanges, the annular channel being configured to be positioned within the opening of the body portion of the dosing dispenser, as suggested in FIGS. 18-19.

A valve assembly 310 in accordance with another embodiment of the present disclosure is shown, for example, in FIGS. 16-24. Valve assembly 310 provides a similar function to valve assembly 16 of FIGS. 1-11 but includes a different configuration for forming a valve to prevent the unwanted flow of fluid. Valve assembly 310 includes a body portion 312 and a conical valve 314 formed to include a slit 316, as shown in FIG. 20. Valve assembly 310 is adapted to be secured within an aperture 317 formed in top wall 98 of body portion 20.

Body portion 312 of valve assembly 310 includes an annular side wall 318 and includes an upper flange 320 and a spaced lower flange 322, as shown in FIG. 20. Body portion 312 is formed to include a syringe receiver 321 adapted to accept fluid-transfer tip 82 of syringe 80. Upper flange 320 includes a top wall 324, a bottom wall 326 and an annular side wall 328. Top wall of upper flange 320 includes a tapered face 330 that is adapted to guide fluid-transfer tip 82 of syringe 80 into syringe receiver 321.

Body portion 312 includes an inner wall 332 that forms syringe receiver 321, as shown in FIG. 20. Inner wall 332 has a diameter that is larger than the diameter of fluid-transfer tip 82 of syringe 80 to form a fluid tight seal between fluid-transfer tip 82 and valve assembly 310. Syringe receiver 321 is configured to allow fluid-transfer tip 82 to extend down in to conical valve 314 to open slit 316 to permit the flow of fluid material 64 from interior region 62 of fluid-storage body 60. Plug 134 of flip-top cap 122 is dimensioned to fit within syringe receiver 321 to form a seal when flip-top cap 122 is in a closed position on body portion 20.

Figure 17:
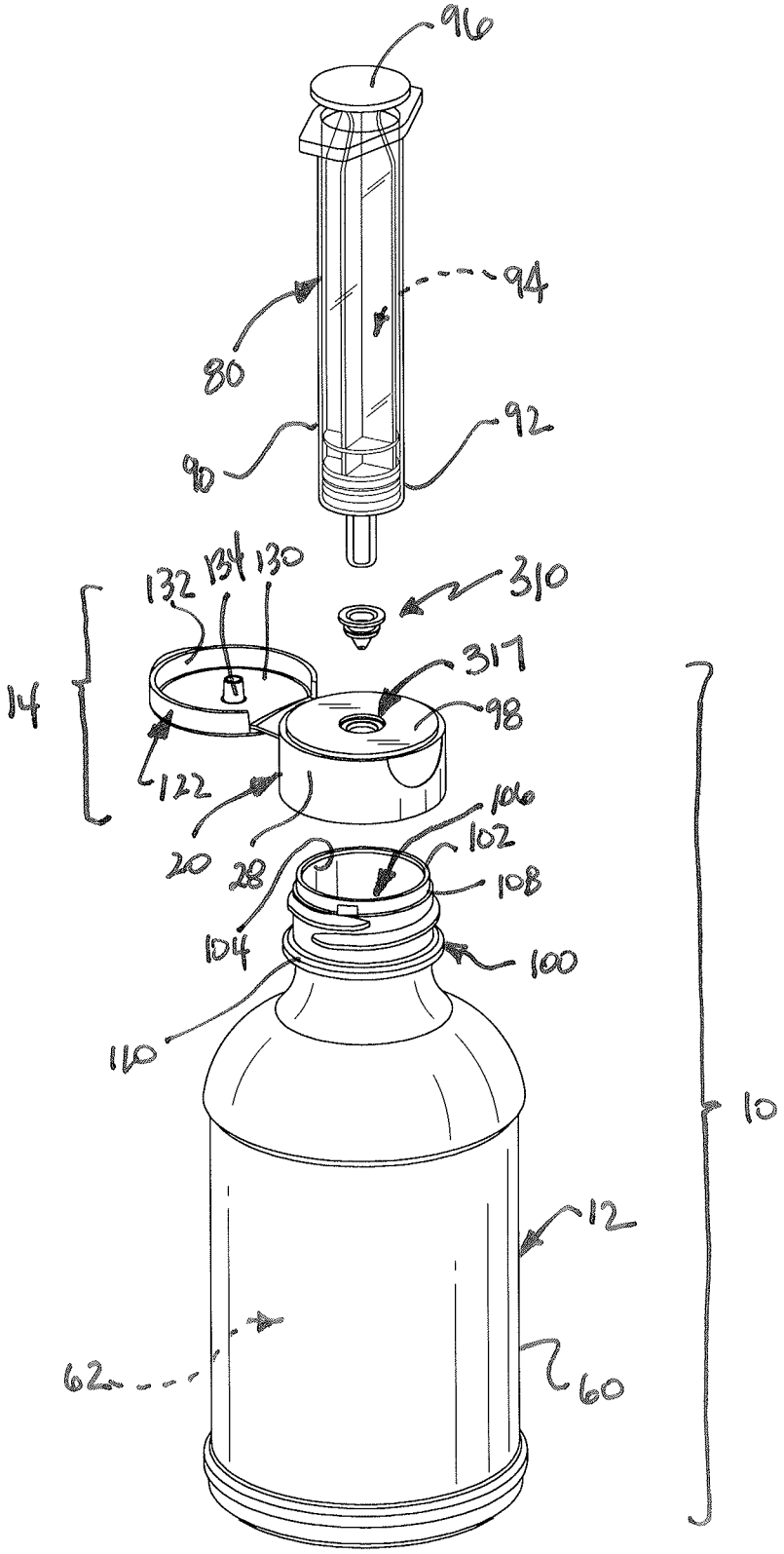
FIG. 17 is an exploded assembly view of the package of FIG. 16 along with the syringe for dosing fluid from the container and showing the dosing dispenser and a valve assembly that is configured to be coupled to the dosing dispenser to block the flow of fluid through the syringe receiver until the fluid-transfer tip of the syringe is inserted into the syringe receiver, as suggested in FIGS. 18-19*a;*
Figure 18:
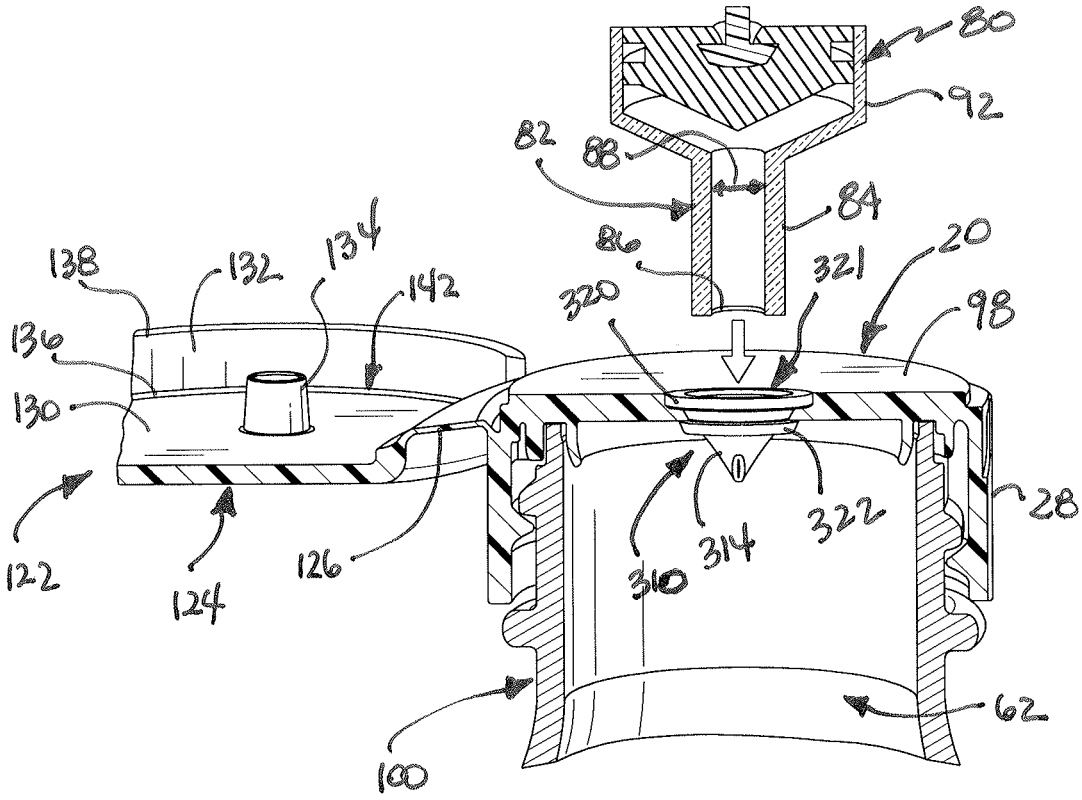
FIG. 18 is a sectional view of the package and syringe taken along line 18-18 of FIG. 16 showing the dosing dispenser before the fluid-transfer tip of the syringe is inserted into the syringe receiver and showing the valve assembly coupled to the body portion of the dosing dispenser, the valve assembling including a tapered elastic wall formed to include a slit that is biased to a closed position to block the flow of fluid from the container.
Figure 19:
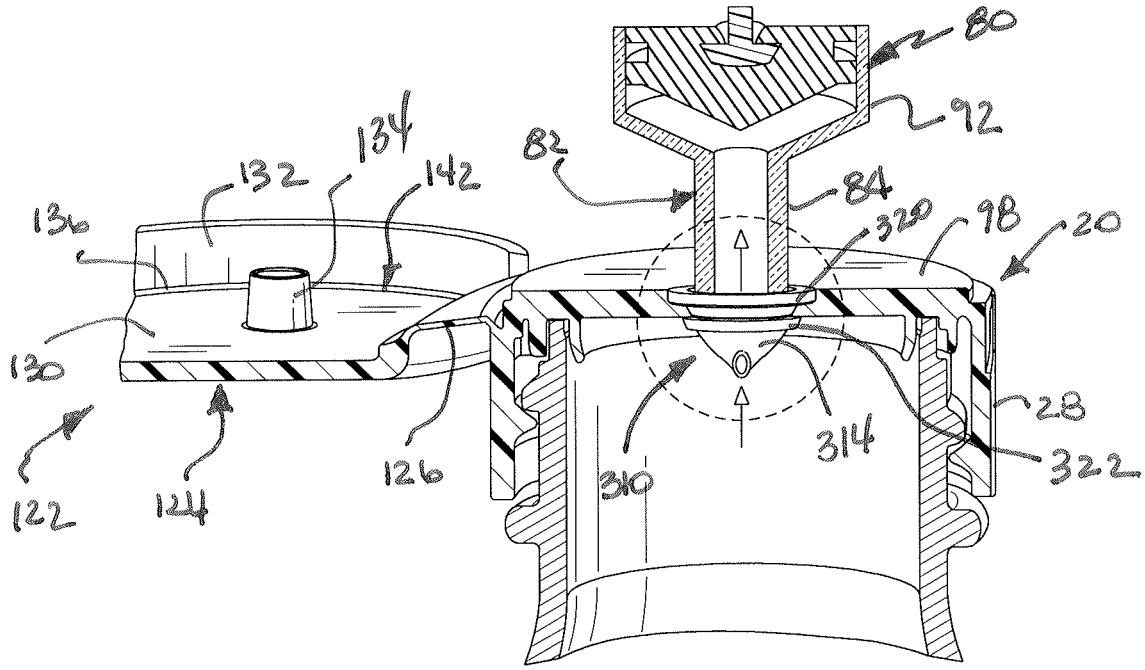
FIG. 19 is a partial sectional view of the package and syringe taken along line 18-18 of FIG. 16 showing the dosing dispenser after the fluid-transfer tip of the syringe has been inserted into the syringe receiver, and showing the fluid-transfer tip engaging the elastic wall of the valve assembly to force the slit from the closed position to an open position to permit the flow of fluid into the fluid-transfer tip of the syringe, as indicated by the double arrows.
Figure 19A:
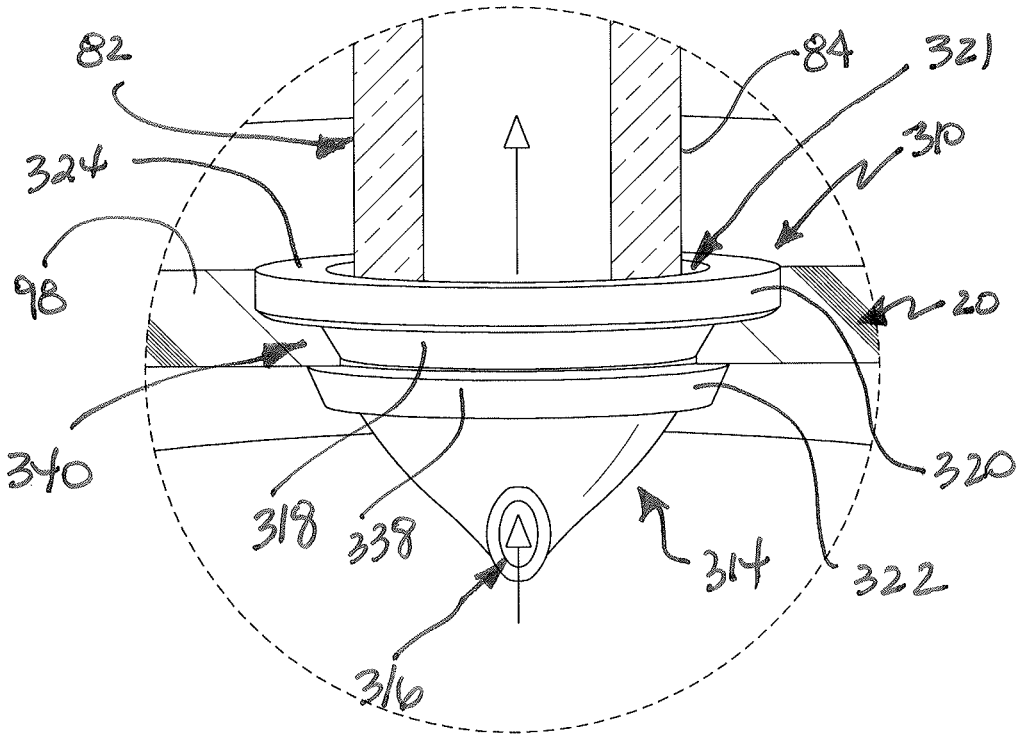
FIG. 19*a* is an enlarged view of FIG. 19 showing the movement of the valve of the valve assembly in an opened position to permit the flow of fluid through the valve into the fluid-transfer tip of the syringe as indicated by the arrows.
Figure 21:
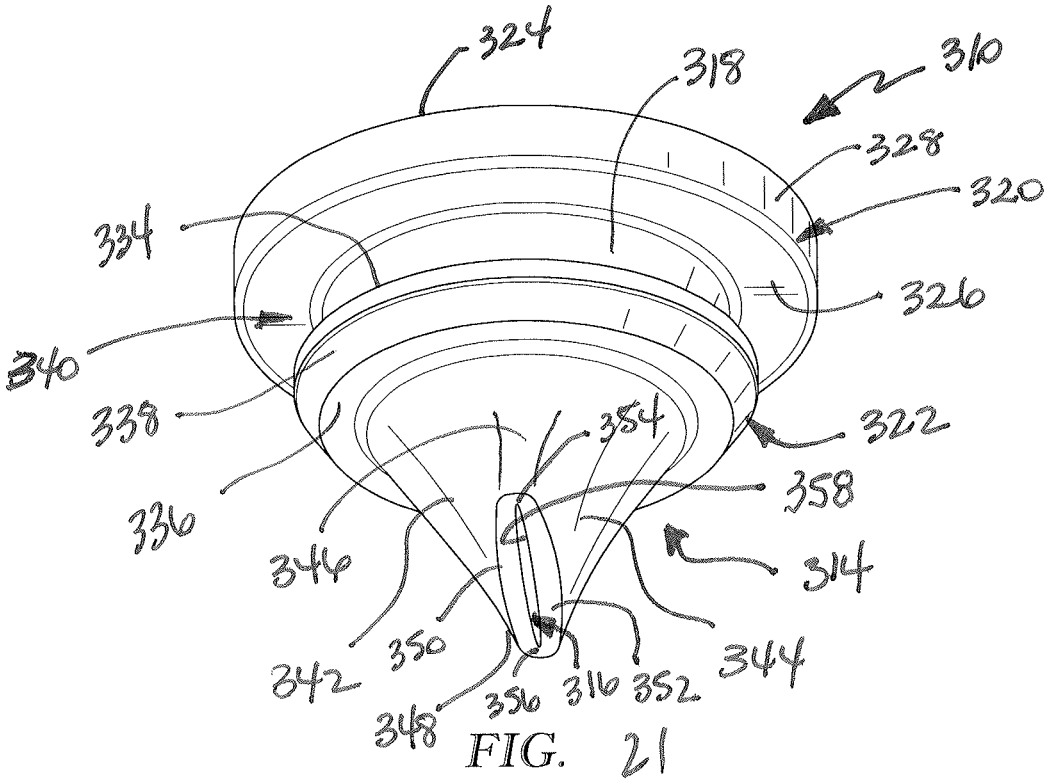
FIG. 21 is bottom perspective view of the valve assembly of FIG. 20 showing the slit formed in the underside of the valve assembly.

Lower flange 322 of body portion 312 includes an upper wall 334, a lower wall 336 and a tapered side wall 338, as shown in FIGS. 20 and 21. Tapered side wall 338 forms a cam surface to assist in positioning valve assembly 310 within aperture 317 formed in top wall 98 of body portion 20, as shown in FIGS. 17 and 20. Because valve assembly 310 is hollow, lower flange 322 can deform inwardly to allow valve assembly 310 to be inserted within aperture 317.

Bottom wall 326 of upper flange 320 and upper wall 334 of lower flange 322 are generally planar to lock valve assembly 310 within aperture 317, as shown in FIG. 20. The space between upper and lower flanges 320, 322 forms a retention channel 340. Retention channel 340 is adapted to be positioned within aperture 317 to secure valve assembly 310 to top wall 98 of body portion 20.

Conical valve 314 of valve assembly 310 includes a first tapered side wall 342 and a second tapered side wall 344, as shown in FIG. 21. Tapered side walls 342, 344 are joined together at edges 346, 348 to form an elongated conical shape. Tapered side wall 342 includes a first face 350 and tapered side wall 344 includes a second face 352.

First and second faces are separated by slit 316 and are connected at edges 354, 356, as shown in FIG. 21. First and second tapered side walls 342, 344 are adapted to bias first and second faces 350, 352 to close slit 316 to form a seal to prevent unwanted fluid material 64 from escaping from container 12. Conical valve 314 also includes an inner surface 358. When fluid transfer tip 82 of syringe 80 is inserted into syringe receiver 321, fluid transfer tip 82 engages inner surface 358 of conical valve 314 forcing tapered side walls 342, 344 to move radially outwardly. Outward movement of tapered side walls 342, 344 causes deformation of first and second faces 350, 352 and the opening of slit 316 to permit the flow of fluid material 64 into syringe 80.

Dosing dispenser 14 is used for dosing fluid material 64 into syringe 80. Dosing dispenser 14 includes body portion 20 that includes top wall 98 formed to include opening 317. Body portion 20 is adapted to mate with a discharge outlet formed on container 12. Body portion also includes annular side wall 28 appended to top wall 98 and arranged to extend downwardly and away from top wall 98 and to cooperate with top wall 98 to form interior region 62.

Valve assembly 310 is positioned within opening 317 of top wall 98. Valve assembly 310 includes syringe receiver 321 and valve 314 formed to include slit 316. Valve assembly 310 also includes first and second flexible side walls 342, 344 that are adapted to bias slit 316 to a closed position to form a seal to prevent unwanted flow of fluid material 64.

Insertion of a portion of syringe 80 into syringe receiver 321 causes slit 316 to move from the closed position to an opened position to permit the flow of fluid material 64 from container 12 and into syringe 80. Removal of syringe 80 from syringe receiver 321 causes slit 316 to return to the closed position to prevent the further release of fluid material 64 from container 20. Valve assembly 310 also includes a body portion 312 formed to include syringe receiver 321.

Body portion 312 of valve assembly 310 includes upper flange 320 that is adapted to be positioned at or above the upper surface of top wall 98 of body portion 20. Body portion 312 also includes lower flange 322 that is adapted to be positioned below top wall 98 of body portion 20. Upper and lower flanges 320, 322 together form an annular recess 340 that is adapted to be positioned with the opening 317 of top wall 98. Lower flange 322 of body portion 312 includes a tapered side wall 338 that is adapted to allow valve assembly 310 to be inserted into opening 317 of top wall 98.

Lower flange 322 of body portion 312 includes planar upper wall 334 that is adapted to be positioned against top wall 98 of body portion 20. Upper flange 320 of body portion 312 has an outer diameter that is greater than an outer diameter of the lower flange 322 so that valve assembly 310 does not get pushed through opening 317 when syringe 80 is inserted into syringe receiver 321.

First and second flexible side walls 342, 344 are tapered and are interconnected by side edges 346, 348. First flexible side wall 342 includes first face 350 and second flexible side wall 344 includes second face 352. Faces 350, 352 are interconnected by edges 354, 356. First and second faces 350, 352 are separated by slit 316 and when first and second faces 350, 352 are in a first position slit 316 is in the closed position and when first and second faces 350, 352 are in a second position slit 316 is the open position.

Figure 22:
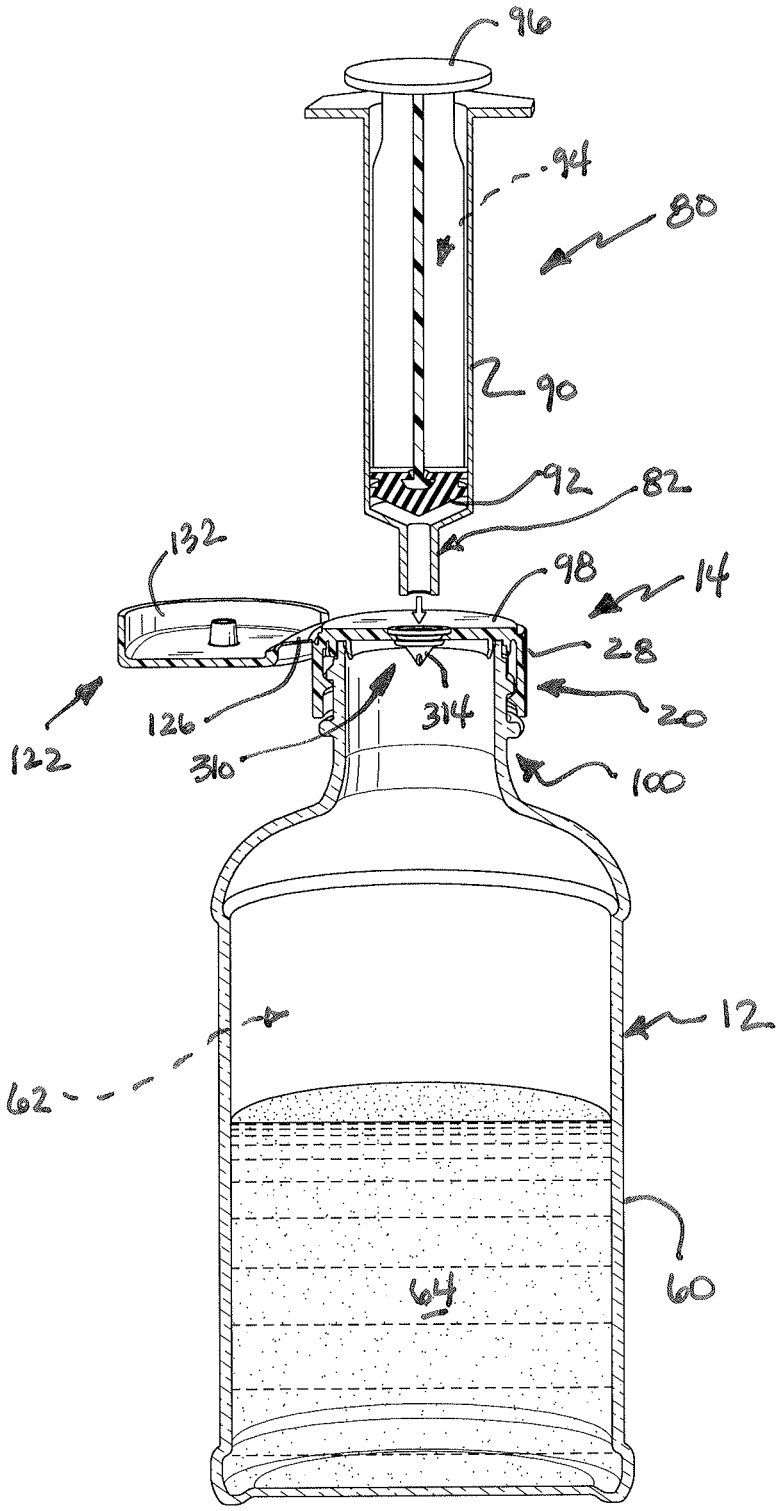
FIG. 22 is a sectional view of the package and syringe taken along line 22-22 of FIG. 1, showing the syringe moving in the direction of the arrow to allow insertion of the fluid-transfer tip into the syringe receiver of the dosing dispenser, the syringe including a plunger movable in a stationary tube relative to an inlet-outlet orifice formed in the fluid-transfer tip of the syringe, and the fluid-transfer tip being provided at a lower end of the stationary tube.
Figure 23:
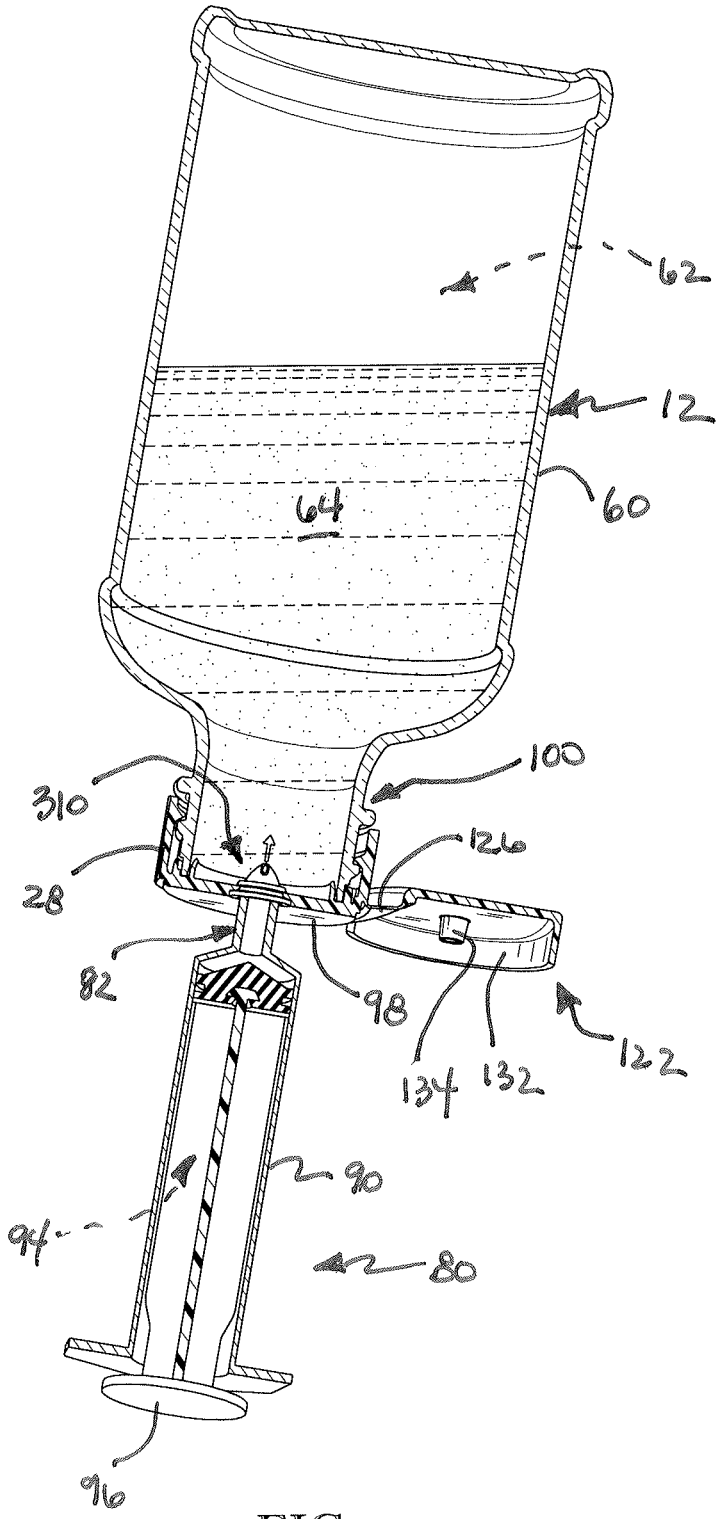
FIG. 23 is a sectional view similar to FIG. 22 showing the container and dosing dispenser in an inverted position and the fluid-transfer tip of the syringe being inserted into the syringe receiver of the dosing dispenser to move the slit formed in the valve assembly to an opened position to permit the dosing of fluid from the container.
Figure 24:
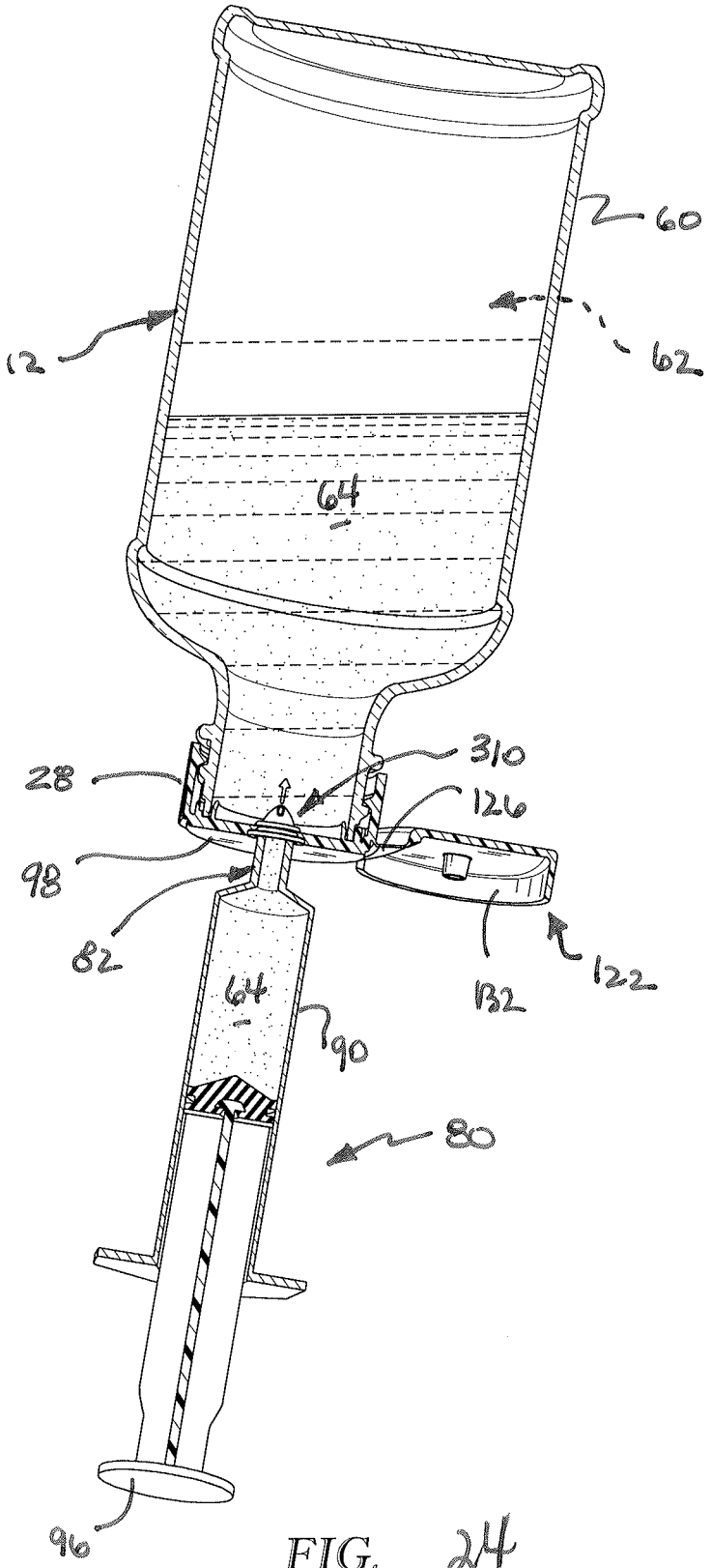
FIG. 24 is a sectional view similar to FIGS. 22-23 showing downward movement of the plunger in the syringe relative to the stationary tube to draw fluid material from the container, past the valve, and into a fluid-storage chamber of the stationary tube included in the syringe through fluid-transfer tip as it engages with the syringe receiver and valve of the dosing dispenser.

In use, fluid-transfer tip 82 of syringe 80 is inserted into syringe receiver 321 of valve assembly 310 in direction of the arrow, as shown in FIG. 22. Syringe 80 including a plunger 92 movable in stationary tube 90 relative to inlet-outlet orifice 86 formed in fluid-transfer tip 82 of syringe 80. Insertion of fluid-transfer tip 82 into syringe receiver 321 flexes tapered side walls 342, 344 of conical valve 314 to cause slit 316 to open.

With container 12 and dosing dispenser 14 in an inverted position and fluid-transfer tip 82 of syringe 80 inserted into syringe receiver 321 of valve assembly 310, fluid material 64 can be extracted from container 12. Removal of fluid transfer tip 82 from syringe receiver 321 allows tapered side walls 342, 344 of conical valve 314 to bias first and second faces 350, 352 to a closed position, closing slit 316.

The invention claimed is:

1. A dosing dispenser comprising a body portion including a top wall formed to include an opening, the body portion adapted to mate with a discharge outlet formed on a container, and an annular side wall appended to the top wall and arranged to extend downwardly away from the top wall and cooperate with the top wall to form an interior region, a valve assembly configured to be inserted into and positioned within the opening of the top wall, the valve assembly including a syringe receiver and a valve formed to include a slit and first and second flexible side walls, wherein the slit is movable from a closed position to an opened position and the first and second flexible side walls of the valve are adapted to bias the slit to the closed position.

2. The dosing dispenser of claim 1, wherein the valve assembly includes a body portion formed to include the syringe receiver.

3. The dosing dispenser of claim 2, wherein the body portion of the valve assembly includes an upper flange adapted to be positioned at an upper surface of the top wall of the body portion.

4. The dosing dispenser of claim 3, wherein the body portion of the valve assembly includes a lower flange adapted to be positioned at a lower surface of the top wall of the body portion.

5. The dosing dispenser of claim 4, wherein the upper and lower flanges form an annular recess that is adapted to be positioned with the opening of the top wall.

6. The dosing dispenser of claim 4, wherein the lower flange includes a tapered side wall that is adapted to allow the valve assembly to be inserted into the opening of the top wall.

7. The dosing dispenser of claim 6, wherein the lower flange includes a planar upper wall that is adapted to be positioned against the top wall of the body portion.

8. The dosing dispenser of claim 4, wherein the upper flange has an outer diameter that is greater than an outer diameter of the lower flange.

9. The dosing dispenser of claim 1, wherein the first and second flexible side walls are interconnected by a pair of side edges.

10. The dosing dispenser of claim 9, wherein the first flexible side wall includes a first face and the second flexible side wall includes a second face and the first and second faces are interconnected by a pair of edges.

11. The dosing dispenser of claim 10, wherein the first and second faces are separated by the slit and when the first and second faces are in a first position the slit is in the closed position and when the first and second faces are in a second position the slit is the open position.

12. A dosing dispenser comprising a body portion including a top wall formed to include an opening and an annular side wall appended to the top wall and arranged to extend downwardly and away from the top wall and to cooperate with the top wall to form an interior region, a flip top cap coupled to the body portion, the flip top cap adapted to cover the top wall when in a closed position and exposing the top wall when in an open position, a valve assembly configured to be inserted into and positioned within the opening of the top wall, the valve assembly including a syringe receiver and a valve formed to include a slit and first and second flexible side walls, first and second flexible side walls of valve are adapted to bias the slit to a closed position to form a seal to limit the flow of liquid, wherein insertion of a portion of a syringe into the syringe receiver causes the slit to move from the closed position to an opened position to permit the flow of liquid through the slit, and removal of the syringe causes the slit to return to the closed position to limit the further release of liquid through the slit.

13. The dosing dispenser of claim 12, wherein flip top cap includes a plug adapted to be positioned with the syringe receiver when the flip top cap is in the closed position to seal the syringe receiver to limit unwanted fluid flow.

14. The dosing dispenser of claim 12, wherein the valve assembly includes a body portion formed to include the syringe receiver.

15. The dosing dispenser of claim 14, wherein the body portion of the valve assembly includes an upper flange adapted to be positioned at an upper surface of the top wall of the body portion.

16. The dosing dispenser of claim 15, wherein the body portion of the valve assembly includes a lower flange adapted to be positioned at a lower surface of the top wall of the body portion.

17. The dosing dispenser of claim 16, wherein the upper and lower flanges form an annular recess that is adapted to be positioned with the opening of the top wall.

18. The dosing dispenser of claim 16, wherein the lower flange includes a tapered side wall that is adapted to allow the valve assembly to be inserted into the opening of the top wall.

19. The dosing dispenser of claim 18, wherein the lower flange includes a planar upper wall that is adapted to be positioned against the top wall of the body portion.

20. The dosing dispenser of claim 16, wherein the upper flange has an outer diameter that is greater than an outer diameter of the lower flange and the first and second flexible side walls are interconnected by a pair of side edges.

* * * * *